US005110705A

United States Patent [19]

Hosoya et al.

[11] Patent Number: 5,110,705

[45] Date of Patent: May 5, 1992

[54] CONTACT TYPE DEVELOPING METHOD AND DEVELOPING UNIT

[75] Inventors: Masahiro Hosoya, Okegawa; Mitsunaga Saito, Tokyo; Mitsuharu Endo, Susono; Yoshimitsu Ohtaka, Mishima; Yukio Futamata, Shizuoka, all of Japan

[73] Assignees: Kabushiki Kaisha Toshiba, Kanagawa; Tokyo Electric Co., Ltd., Tokyo, both of Japan

[21] Appl. No.: 502,171

[22] Filed: Mar. 30, 1990

[30] Foreign Application Priority Data

| | | | |
|---|---|---|---|
| Mar. 31, 1989 | [JP] | Japan | 1-81919 |
| Mar. 31, 1989 | [JP] | Japan | 1-81920 |
| Mar. 31, 1989 | [JP] | Japan | 1-81922 |
| Mar. 31, 1989 | [JP] | Japan | 1-81923 |
| Jun. 30, 1989 | [JP] | Japan | 1-168605 |

[51] Int. Cl.[5] ..... G03G 15/08

[52] U.S. Cl. ..... 430/120; 118/653

[58] Field of Search ..... 430/120; 118/653, 651

[56] References Cited

U.S. PATENT DOCUMENTS

| | | | |
|---|---|---|---|
| 3,754,953 | 8/1973 | Chang | 117/17.5 |
| 4,232,628 | 11/1980 | Shelffo | 118/653 |
| 4,868,600 | 9/1989 | Hays et al. | 118/653 |
| 4,913,088 | 4/1990 | Kanbe et al. | 118/653 |

FOREIGN PATENT DOCUMENTS 60-22352 1/1979 Japan .

*Primary Examiner*—John Goodrow
*Attorney, Agent, or Firm*—Finnegan, Henderson, Farabow, Garrett and Dunner

[57] ABSTRACT

In a developing method in which a thin layer of toner is formed on the surface of a toner carrier to which a developing bias voltage is applied and the thin layer of toner is supplied to an electrostatic latent image to thereby render the electrostatic latent image visible, the improvement wherein:

when let it be supposed that:

a quantity of electrification of toner that adheres to a latent image holding body by development is q [C/kg];

a quantity of charges accumulated by the toner due to its triboelectrification with the latent image holding body is $q_p$ [C/kg];

an electric resistance of the toner carrier is R [$\Omega \cdot m^2$];

an effective length of the toner carrier is l [m];

an effective surface area of the toner carrier is $S_r$ [$m^2$];

a quantity of the toner that adheres to the latent image holding body by development is $m_p$ [$kg/m^2$];

a speed of movement of the surface of the latent image holding body is $V_p$ [m/sec];

a quantity of the toner that adheres to the surface of the toner carrier is m [$kg/m^2$]; and a speed ratio of the surface of the toner carrier to that of the latent image holding body is k, these values are so adjusted as to satisfy the following conditional expression:

$$-100 < \{-(q-q_p)\, m_p V_p l + q_p (km - m_p) V_p l\} \cdot R/S_r < 100.$$

A developing unit is selectively arranged so that this developing method can suitably be applied. The developing method and the developing unit cause an appropriate quantity of toner to be supplied constantly to the electrostatic latent image formed on the surface of the electrostatic latent image holding body through the toner carrier, thereby allowing a uniform, high density, sharp image with no fog on non-image portions to be provided.

20 Claims, 19 Drawing Sheets

| | | | | |
|---|---|---|---|---|
| DIELECTRIC FLUX DENSITY D | $D_p$ | $D_t$ | $D_i$ | |
| ELECTRIC POTENTIAL $\phi$ | $\phi_p$ | $\phi_t$ | $\phi_i$ | $V_b$ |
| ELECTRIC CHARGE DENSITY (VOLUME DENSITY) | 0 | $\rho_t$ | 0 | |
| (SURFACE DENSITY) | $\sigma_b$ | $\sigma_p$ | $\sigma_i$ | $\sigma_r$ |
| DIELCTRIC CONSTANT $\varepsilon$ | $\varepsilon_p$ | $\varepsilon_t$ | $\varepsilon_i$ | |

CONTACT TYPE DEVELOPING METHOD AND DEVELOPING UNIT

BACKGROUND OF THE INVENTION

1. Field of the Invention

This invention relates to a developing method and a developing unit which renders an electrostatic latent image visible in electrophotographic devices or electrostatic recorders. More particularly, it is directed to a developing method which can provide a high quality image using a single component toner and a developing unit suitable for applying such a developing method.

2. Description of the Related Art

As a developing method using a single component toner (developing medium), a pressure developing method has been known by specifications such as those of U.S. Pat. Nos. 3,152,012; 3,754,963; and 3,731,146, and publications such as Japanese Patent Laid Open Nos. 13088/1972 and 13089/1972, Japanese Patent Publications Nos. 36070/1976 and 36414/1977. This pressure developing method is characterized by forming a thin layer of single component developing medium composed solely of a nonmagnetic toner on the surface of a toner carrier which is elastic, conductive and roughened; and bringing this toner layer into contact with the surface of an electrostatic latent image holding body which holds an electrostatic latent image in such a manner that their relative speeds become zero. Its advantage includes a simpler device and an easy color image production. However, from the results of the additional tests conducted by the present inventor and his group the following problems were addressed.

(1) The aforesaid pressure developing method is characterized principally as moving both surfaces of the toner layer and electrostatic image relative to each other at a circumferential speed of substantially zero. However, the tests indicated that images developed under the above condition lacked in sharpness and suffered from fog on non-image portions and nonuniform density. In contrast thereto, when a certain speed difference was given, the toner particles rolled and slipped at the position where the toner layer contacted the electrostatic latent image; and this encouraging electrification of toner particles and adjustment of image formation, produced the extremely sharp, consistent and high density developed images that were free from fog on non-image portions.

(2) In the pressure developing method, the electrically charged particles, or toner, on the toner carrier is caused to transfer to the electrostatic latent image, so that current (hereinafter referred to as "developing current") flows in the electric circuit between the toner carrier and the developing bias power supply. Thus, it is necessary to adjust a resistance on the toner carrier surface or a resistance between the toner carrier surface and the developing bias power supply to above a predetermined value. In the aforesaid prior art, however, there was no disclosure of a practicable concept relevant to this point.

(3) Moreover, the current, whose flow is caused mainly by the transfer of the toner particles, varies depending on such factors as the quantity of toner electrification, the quantity of toner adhesion to the electrostatic latent image formed on the surface of the electrostatic latent image holding body, the speed of movement of the toner carrier surface and the dimensions of the toner carrier. Therefore, the relationship between these factors and the above resistance may cause the variation in a potential on the surface of the toner carrier, i.e., an effective developing bias, and such a variation may in some cases impair the developed images with fog and insufficient density.

(4) Compared to a method utilizing magnetization to attract and carry magnetic toner on the surface of the toner carrier, this pressure developing method has difficulty in carrying the nonmagnetic developing medium (toner) on the surface of the toner carrier and then constantly supplying a predetermined quantity thereof to a latent image. Because for the nonmagnetic toner there is no remotely acting force such as a magnetic force that ensures to form and recover the thin layer of toner on the surface of the toner carrier when the toner layer has been consumed from the toner layer surface by the development of a predetermined latent image (the capability of quickly recovering the toner thin layer on the toner carrier and constantly supplying a predetermined quantity of toner thin layer to the latent image is hereinafter referred to as "toner transferability"). Defects in toner transferability impairs density in the latter half of a developing process of making a solid image. Thus, in order to improve the toner transferability, a sponge roller or a brush roller is disposed in a toner container. A method of rubbing the nonmagnetic toner on the toner carrier by the above roller to thereby supply it is disclosed, e.g., in Japanese Patent Laid Open Nos. 5274/1987, 7067/1987 and 95558/1987.

(5) In the aforesaid pressure developing method, the toner carried by the toner carrier is pressed on or put in contact with the electrostatic latent image for development, and this requires that a developing roller that is elastic and conductive be used as a toner carrier. If the electrostatic latent image holding body is made of a rigid body, it is essential that the toner carrier is formed of an elastic body in order to avoid damaging the electrostatic latent image holding body.

A known example of a toner carrier thus formed is a developing roller, in which the surface of a metal roller base material is provided with an elastic body layer such as a foam rubber or a polyurethane foam, and further with a flexible conductor layer and an outermost layer having graphite particles dispersed in a binding resin successively coated one upon the other (Japanese Patent Laid Open No. 13088/1972). More specifically, a toner carrier (developing roller) whose surface layer is coated with the above-mentioned mixture of graphite and a binding resin, using a horizontally coating machine, to a thickness of about 20 μm on a polyethylene terephthalate thin plate that has been subjected to a chemical processing by aluminum.

(6) Moreover, since a thin layer of toner is formed on the toner carrier in the pressure developing method, means for pressing a toner layer forming member on the toner carrier is employed. As this toner layer thickness regulating means, the following two types are generally known.

(a) The middle part of a platelike toner layer thickness regulating member is pressed on the toner carrier.

(b) The end part of a platelike toner layer thickness regulating member is pressed on the toner carrier.

The method or means (a) in which the middle part of the platelike toner layer thickness regulating member is pressed is disclosed in, e.g., Japanese Patent Publication No. 16736/1988, Japanese Patent Laid Open Nos. 165866/1982 and 73649/1985 and 138967/1986, and in the specification of U.S. Pat. No. 4,521,098. In this method, the middle part of the platelike regulating member made of an elastic body is pressed not only to form a toner thin layer of uniform thickness but also to properly triboelectrify toner particles to thereby allow a satisfactory visible image to be produced.

On the other hand, the means (b) in which the end part of the platelike toner layer thickness regulating member is pressed is disclosed in such publications as Japanese Patent Publication No. 36070/1976 and 15068/1985, and Japanese Patent Laid Open Nos. 23638/1978 and 116559/1983, 95559/1987, 96981/1987 and 113178/1987. These known means for pressing the end part are classified into the following three types.

(i) Method of pressing a tip formed into a cylindrical surface (Japanese Patent Publication No. 36070/1976).

(ii) Method of pressing a tip that is sharp (Japanese Patent Laid Open No. 23638/1978 and others).

(iii) Method of pressing a tip formed into a plane surface (Japanese Patent Laid Open No. 95559/1987 and others). According to these methods, it is possible to form a desired toner thin layer with a relatively low pressing force, thereby allowing to overcome various problems associated with the method (a) of pressing the middle part. However, these methods (b) have the following problems. In the case where a sharp tip is pressed such as in method (ii), a strict pressure control is required to properly handle pressure concentration, which is caused by a very small area of contact between the toner carrier and the regulating member. A slightest inaccuracy in machining the tip resulted in inconsistency of the toner layer, and there was a tendency that the formed toner layer was excessively thin. In case of method (iii), the section of the end part of the platelike regulating member is pressed on the toner carrier, therefore there is no such problems as presented in method (ii) in the normal condition, but if slight variations in the state of mounting the regulating member cause the edge of the section of the end part to contact the toner carrier, the problems similar to those in method (ii) may be caused. On the other hand, in method (i), there is no sharp edge is found in the regulating member. Therefore, no problems such as entailed in methods (ii) and (iii) by small variations in its mounting conditions will be caused, and thus the manufacture and assembly of the device can be facilitated. If the end part is curved, the effect that is intermediate between the effect of the means for pressing the middle part and that of the means for pressing the sharp end part can be obtained, thus forming a thin layer of toner and charging toner particles at a comparatively lower pressure.

As to the problem (1), Japanese Patent Publication No. 12627/1985 and Japanese Patent Laid Open No. 23638/1978 and others disclose that a better quality image can be produced by moving the toner carrier faster than the electrostatic latent image. As to the problem (2), many proposals have been made on a preferable range of volume resistivity of the toner carrier surface. Japanese Patent Publication No. 22352/1985 has proposed use of a conductive toner carrier of below $10^5$ Ω·cm; Japanese Patent Publication No. 3949/1987 below $10^8$ Ω·cm; Japanese Utility Model Publication No. 35097/1987, above $10^{13}$ Ω·cm; and Japanese Patent Publication No. 26386/1988, about $10^8$ Ω·cm, respectively. However, such a differently set range of resistance is suggestive of possible variations of the optimal condition of development due to factors indicated in the problem (3), so that it will be difficult to produce a satisfactory developed image unless considerations are given to balancing these factors on an integrated basis.

As to the problem (4), the toner transferability could be improved to some extent; but in the case of inadequate triboelectrification between the toner carrier surface and the nonmagnetic toner particles, the nonmagnetic toner particles cannot adhere to the toner carrier surface, thereby leaving no chance of improving the transferability. Although the transferability is acceptable at an initial stage, it is often subjected to deterioration in the long run as the triboelectrification between the toner carrier surface and the nonmagnetic toner particles becomes inadequate due to a so-called "filming", or a phenomenon in that the nonmagnetic toner thin film is formed on the toner carrier surface.

By the way, generally known methods of controlling the density of an image to be produced in electrophotographic devices such as copying machines and laser printers involve control of the quantity of light for exposing an electrostatic latent image or of the developing bias for being applied to the toner carrier. These methods allow image density to be controlled to a certain extent; but if these methods applied to a developing method in which an image is developed by forming a thin layer of nonmagnetic toner on the toner carrier and supplying this toner layer to an electrostatic latent image, there is an upper limit in the obtained image density, and thus it is in no way possible to further increase it. It is because there is no further supply of toner to improve the density once all the thin layer of nonmagnetic toner has been consumed. An attempt to increase the thickness of the nonmagnetic toner layer to improve the density causes the nonmagnetic toner particles that adhere to the surface of the toner carrier to "fog" the non-image portions without going through a process of contacting the toner carrier, the toner layer thickness regulating member and the toner supplying member.

As to the problem (5), even if the elastic body layer satisfied the aforesaid condition, compression set occurred on the elastic body layer and gave, in some cases, adverse effects on the image when the elastic body layer was left under pressure for a long while. On the other hand, an elastic material that is less subject to compression set generally has a larger hardness; and if the toner carrier became eccentric, it was not easy to obtain a development nip width for covering the variation due to eccentricity, thereby inviting inconsistency in image density. Further, another difficult problem is that the smoothening of the surface of the toner carrier depends on the surface condition of the elastic body layer that forms its underlayer; i.e. the surface forming condition suitable for its material.

As to the durability of the toner carrier, there was no specific disclosure that gave a solution to the problem that a toner carrier with a conductive layer formed on the elastic body layer was subjected to damage, wear or flaking of the conductive layer during its use. Thus, not knowing the proper durability of a conductive layer, toner carriers that are too expensive to provide a required life were manufactured; the required life was not satisfied; or manufacturing control was so difficult that there was a noticeable inconsistency per lot.

A toner carrier that is made of an elastic material will provide a variety of practical advantages but bring the following disadvantages as well. When a toner layer forming member is pressed to form a thin layer of toner of a desired thickness, the pressed portion is hollowed to cause a so-called compression set. This defect tends to occur not only when one part of the toner carrier is continuously pressed for a long period of time but also at high or low temperatures. Once the compression set occurs, both the toner layer and the developing electric field at the development are subjected to being nonuniform, or it is made difficult to move the toner carrier and the latent image holding body at a constant speed. This gives a developed image nonuniform density and white and black stripes. Still worse is the fact that once the compression set is present, the toner carrier, even if used for the first time, may produce poor images. Thus, it is desired that a better environment should be ensured when the developing unit is warehoused or shipped.

As to the problem (6), in the developing units which press the middle part of the platelike regulating member (a), the toner particles are more likely to stay in a wedge-shaped space formed between the regulating member and the toner carrier. Since the incoming toner particles tend to press them out, it is required that a comparatively high pressure be employed to press the toner carrier to form a thin layer of toner of a desired thickness. This entailed the problems that the toner adhered to the toner carrier or the regulating member, and that a large force was required for driving the toner carrier.

It was found also that even the most practicable method (i) of pressing the end part formed into a cylindrical surface, among methods of pressing the end part of the platelike regulating member (b), suffered from the following problems. For example, Japanese Patent Publication No. 36070/1976 states that a regulating member which is made of polytetrafluoroethylene or polyformaldehyde (DELRIN ®) and whose end part is formed into a cylindrical surface is suitable. However, from the additional tests conducted by the inventor and his group it was found that there were shortcomings such as inconsistency in the toner layer caused by inaccuracy in forming the regulating member, especially warpage and undulations along its length; inability of offsetting the mounting and forming inaccuracy of the regulating member because its material is nearly rigid; and difficulty in forming an accurate cylindrical surface. There was a tendency that the toner is gradually deposited on the surface of the regulating member by its use over a long period, thus inviting the toner layer inconsistency.

It is therefore an object of the present invention to provide a developing method which is capable of easily producing a high quality image that is sharp and free from fog on non-image portions.

A second object of the present invention is to provide a developing method which is capable of easily producing a uniform, high density image.

A third object of the present invention is to provide a developing method which is capable of easily producing a uniform, high density image by constantly forming and holding a predetermined toner layer on the surface of a toner carrier.

A fourth object of the present invention is to provide a developing unit which is capable of constantly producing a high-definition developed image free from nonuniform density or fog on non-image portions.

A fifth object of the present invention is to provide a developing unit which is capable of constantly producing a high-definition developed image free from nonuniform density or fog on non-image portions by forming and holding a consistent toner layer on the toner carrier.

SUMMARY OF THE INVENTION

In a developing method in which a thin layer of toner is formed on the surface of a toner carrier to which a developing bias voltage is applied and the thin layer of toner is supplied to an electrostatic latent image to thereby render the electrostatic latent image visible, the improvement wherein:

when let it be supposed that:

a quantity of electrification of toner that adheres to a latent image holding body by development is q [C/kg];

a quantity of charges accumulated by the toner due to its triboelectrification with the latent image holding body is $q_p$ [C/kg];

an electric resistance of the toner carrier is R [$\Omega \cdot m^2$];

an effective length of the toner carrier is l[m];

an effective surface area of the toner carrier is $S_r$ [$m^2$];

a quantity of the toner that adheres to the latent image holding body by development is $m_p$ [$kg/m^2$];

a speed of movement of the surface of the latent image holding body is $V_p$ [m/sec];

a quantity of the toner that adheres to the surface of the toner carrier is m [$kg/m^2$]; and a speed ratio of the surface of the toner carrier to that of the latent image holding body is k, these values are so adjusted as to satisfy the following conditional expression:

$$-100 < \{-(q-q_p)m_pV_pl + q_p(km-m_p)V_pl\} \cdot R/S_r < 100.$$

A developing unit is selectively arranged so that this developing method can suitably be applied.

The developing method and the developing unit according to the present invention causes an appropriate quantity of toner to be supplied constantly to the electrostatic latent image formed on the surface of the electrostatic latent image holding body through the toner carrier, thereby allowing a uniform, high density, sharp image with no fog on non-image portions to be provided.

Figure 13A:
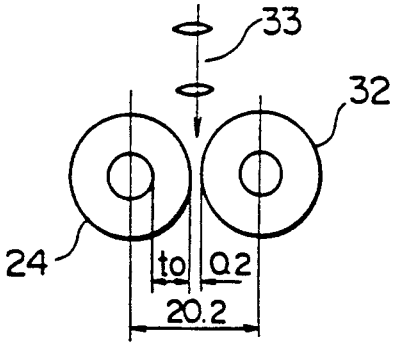
Figure 13B:
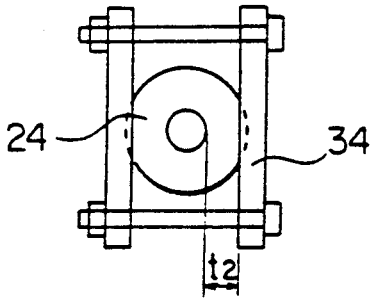
Figure 13C:
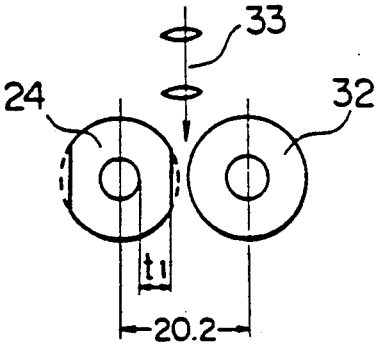
Figure 15:
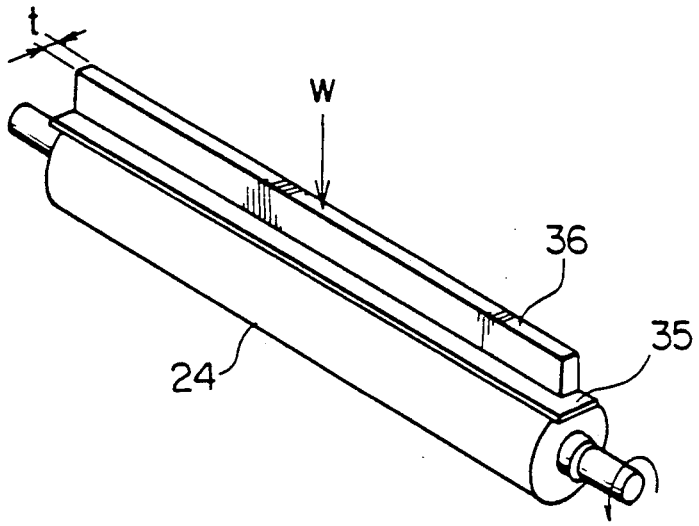
Figure 14A:
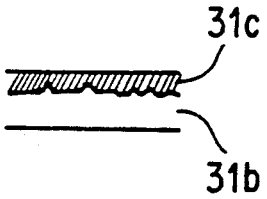
Figure 14B:
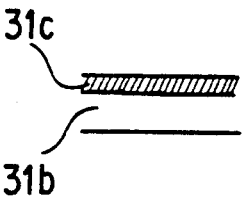
Figure 16:
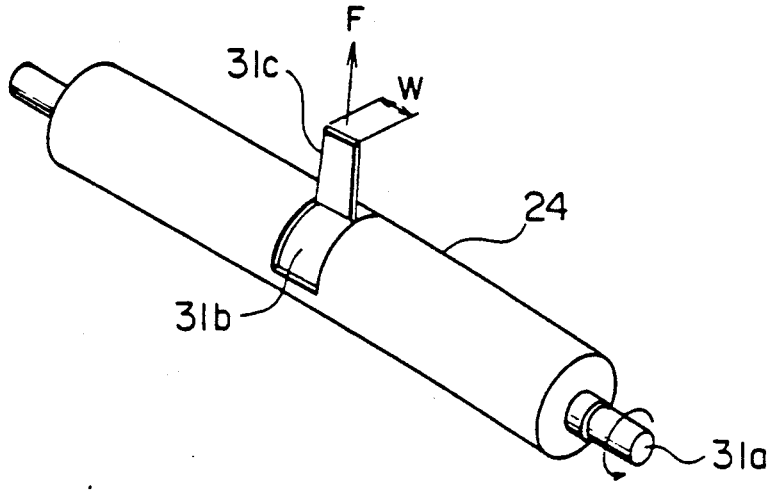
Figure 17:
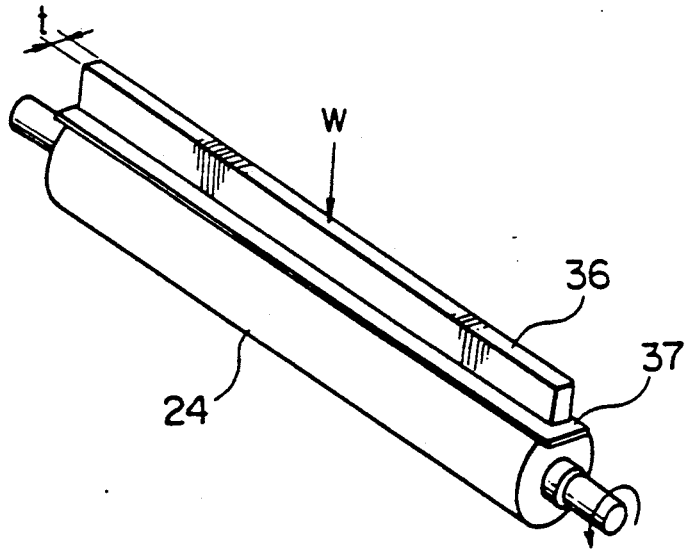
Figure 26:
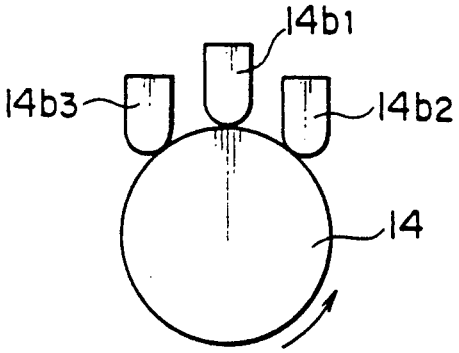
Figure 27:
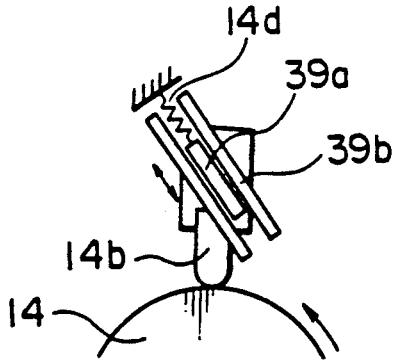
Figure 28A:
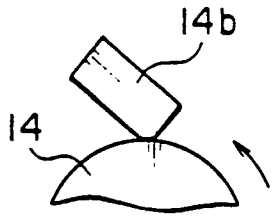
Figure 28B:
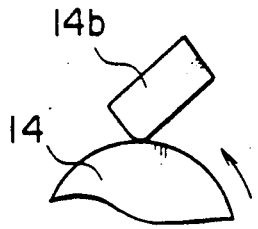
Figure 29A:
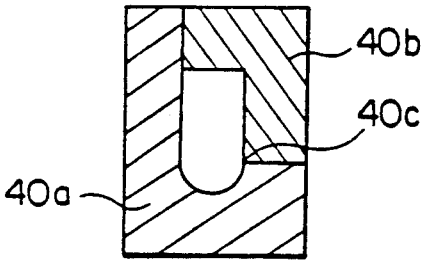
Figure 29B:
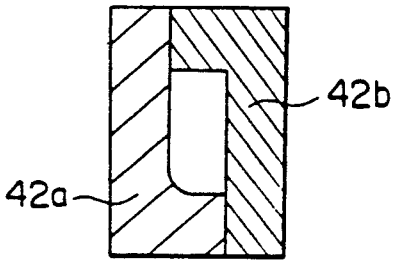
Figure 30A:
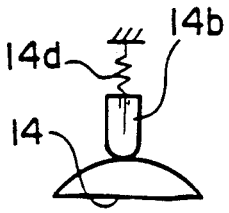
Figure 30B:
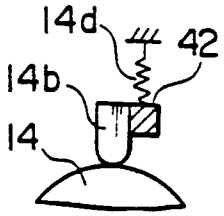
Figure 30C:
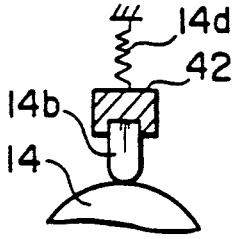
Figure 30D:
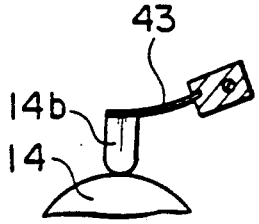
Figure 31:
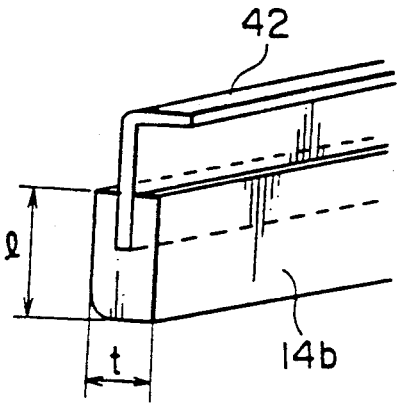
Figure 32:
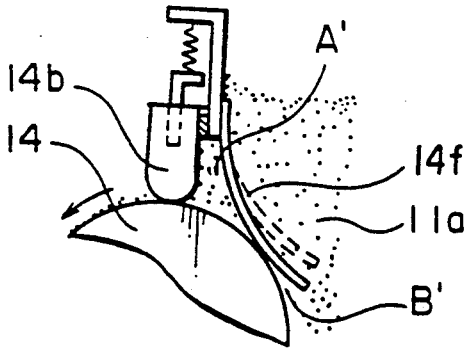
Figure 33:
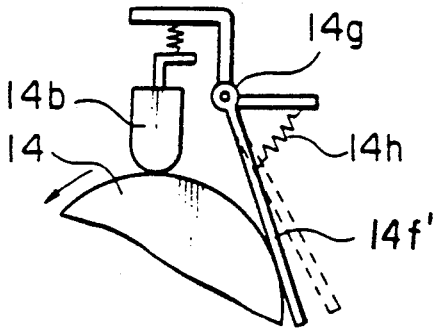
Figure 34:
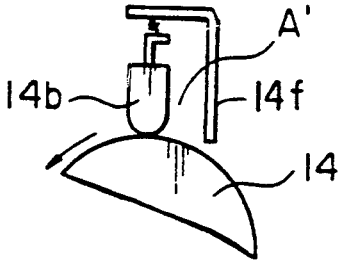
Figure 35:
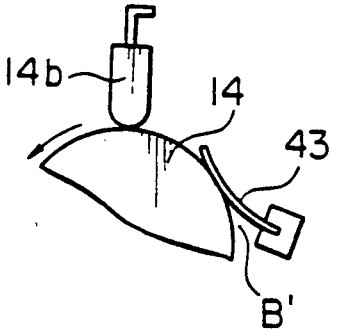

Parts (a), (b) and (c) of FIG. 13 are side views showing a method of measuring compression set of the toner carrier to be used in the developing unit;

Parts (a) and (b) of FIG. 14 are sectional views showing an arrangement of the main portion of the toner carrier;

FIG. 15 is a perspective view showing an abrasion resistance test method of the toner carrier to be used in the developing unit;

FIG. 16 is a perspective view showing a method of measuring the flaking strength of the toner carrier to be used in the developing unit;

FIG. 17 is a perspective view showing a method of measuring the friction coefficient of the toner carrier to be used in the developing unit;

FIGS. 18 to 21 are sectional views each showing a different arrangement of the main portion of the developing unit according to the present invention;

FIGS. 22 to 25 are side views each showing a different arrangement of a toner layer thickness regulating member in the developing unit according to the present invention;

FIG. 26 is a diagram for explaining the relationship between the layout and characteristics of the toner layer thickness regulating member in the developing unit according to the present invention, FIG. 27 is a sectional view showing the main portion of an arrangement of another supporting mechanism of the toner layer thickness regulating member;

Parts (a) and (b) of FIG. 28 are diagrams for explaining the difference in characteristics depending on the direction of the toner layer thickness regulating member in the developing unit according to the present invention;

Parts (a) and (b) of FIG. 29 are sectional views showing examples of profiles for molding the toner layer thickness regulating member to be used in the developing unit according to the present invention;

Parts (a), (b), (c) and (d) of FIG. 30 are side views each showing the main portion of a different supporting arrangement of the toner layer thickness regulating member in the developing unit according to the present invention;

FIG. 31 is a diagram for explaining the difference in characteristics depending on the dimensions and profiles of the toner layer thickness regulating member in the developing unit according to the present invention;

FIG. 32 is a sectional view showing the main portion of an example of installation of a platelike toner supplying member in the developing unit according to the present invention; and FIGS. 33 to 35 are sectional views each showing the main portion of a different example of installation of the platelike toner supplying member in the developing unit according to the present invention.

DETAILED DESCRIPTION OF THE PREFERRED EMBODIMENTS

Embodiment 1

A general arrangement or functions of a developing method according to the present invention will hereunder be described with reference to FIGS. 1 and 2.

Figure 1:
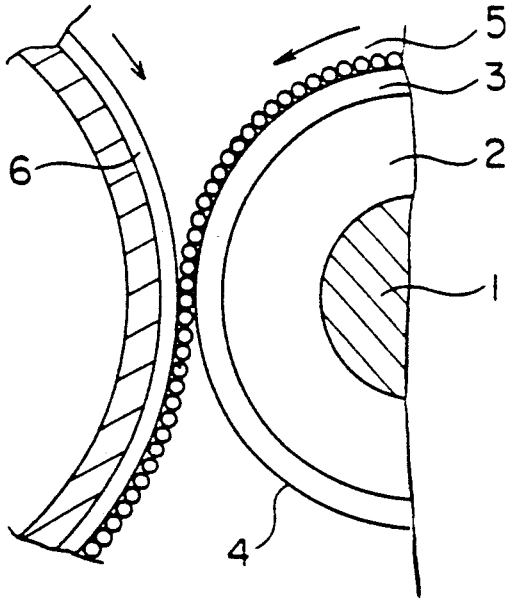
FIG. 1 is a sectional view showing the main portion of a developing unit for explaining a developing method according to the present invention.

FIG. 1 is a sectional view showing the main portion of a developing unit for explaining the functions of a developing method according to the present invention. The developing method according to the present invention is performed by forming a toner layer 5 composed, e.g. of a single component nonmagnetic toner on the surface of a toner carrier (developing roller) 4 comprising a conductive shaft 1, an elastic body layer 2 and a surface resin layer 3, and causing this toner layer 5 to contact the surface of a photosensitive drum 6 that serves as an electrostatic latent image holding body. Although the developing method according to the present invention may of course be applicable to known regular developing methods, a case in which it is applied to reverse development will herein be illustrated.

First, the toner carrier is classified as indicated below by its electric resistance value, and it will be theoretically analyzed on the basis of a model shown in FIG. 2.

(A) Conductive toner carrier . . . Using a surface resin layer 3 that is conductive, a developing bias is directly applied to this surface layer from a power supply (not shown). If conduction is established between the shaft 1 and the surface layer 3 by applying the conductive resin layer to both ends of the toner carrier 4, the developing bias may be applied to the shaft 1. The use of an elastic body layer 2 that is conductive may likewise allow the shaft 1 to be the source of the developing bias; in this case, the surface resin layer 3 may be dispensed with.

(B) Semiconductive toner carrier . . . Using an elastic body layer 2 that is semiconductive and a surface layer 3 that is conductive, a developing bias is applied to the shaft 1.

(C) Dielectric toner carrier . . . Using an elastic body layer 2 that is conductive and a surface layer 3 that is dielectric, a developing bias is applied to the shaft 1.

Figure 2:
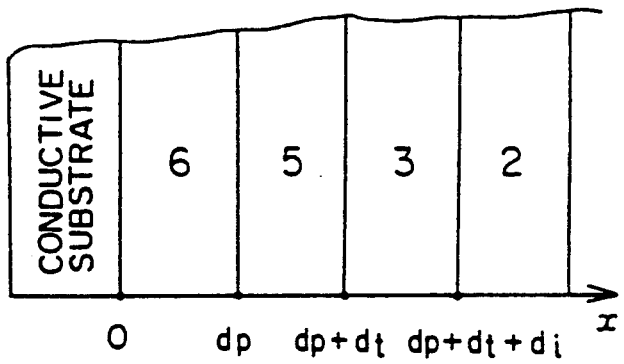
FIG. 2 is a schematic diagram showing the relationship between the components and electric characteristics of a toner carrier for explaining the developing method according to the present invention.

FIG. 2 is a schematic showing the development region of FIG. 1 in enlarged form. The physical values on or in the surface of each of the layers including the elastic body layer 2, the surface resin layer 3, the toner layer 5 and the photosensitive body surface of the electrostatic latent image holding body 6 are defined as indicated below. For the purpose of generalizing the theory, the dielectric toner carrier will first be analyzed.

The Gaussian rule will be applied to each region of FIG. 2.

$$\text{div } D_p = 0 \quad (1)$$

$$\text{div } D_t = \rho_t (\rho_t = \text{constant}) \quad (2)$$

$$\text{div } D_i = 0 \quad (3)$$

The boundary conditions with a unit normal vector being n are as follows.

$$D_p \cdot n = \sigma_b \quad (4)$$

$$(D_t - D_p) \cdot n = \sigma_p \quad (5)$$

$$(D_i - D_t) \cdot n = \sigma_t \quad (6)$$

$$-D_i \cdot n = \sigma_r \quad (7)$$

$$\phi_p(0) = 0 \quad (8)$$

$$\phi_p(dp) = \phi_t(dp) \quad (9)$$

$$\phi_t(dp + dt) = \phi_i(dp + dt) \quad (10)$$

$$\phi_i(dp + dt + di) = V_b \quad (11)$$

Let it be supposed that the surface potentials of the photosensitive body layer 6 and the dielectric layer 3 before reaching the development region are $V_o$ and $V_i$, then $$\sigma_p = \epsilon_p V_o / dp \quad (12)$$

$$\sigma_t = \Gamma_t V_i / di \quad (13)$$

The electric field within the toner layer is found by solving the above problem of boundary value as shown below.

$$\frac{d\phi_t}{dx} = -\frac{\rho_t}{\epsilon_t} X + \frac{\rho_t dp}{\epsilon_t} - \frac{(V_o - V_b) - V_i}{\epsilon_t A} + \frac{\rho_t dt}{\epsilon_t A}\left(\frac{dt}{2\epsilon_t} + \frac{di}{\epsilon_i}\right) \quad (14)$$

where $$A = dp/\Gamma_p + dt/\Gamma_t + di/\Gamma_i \quad (15)$$

The toner layer is divided at a point Xo where the electric field within the toner layer becomes zero to thereby cause an image to be developed. The quantity $m_p$ of toner that adheres on the surface of the electrostatic latent image holding body (photosensitive drum) 6 is obtained as follows.

$$m_p = km(Xo - dp)/dt \quad (16)$$

where, m is the quantity of toner that adheres on the surface of the toner carrier 4; $V_r$ and $V_p$ are the surface velocities of the toner carrier 4 and the electrostatic latent image holding body 6; and k is the velocity ratio $V_r/V_p$.

From equations (14) and (16), an equation showing the development characteristics of the dielectric toner carrier can be obtained as follows.

$$mp = \frac{km}{A}\left(-\frac{(V_o - V_b) - V_i}{dt\rho_t} + \frac{dt}{2\epsilon_t} + \frac{di}{\epsilon_t}\right) \quad (17)$$

Thus, the equation showing the characteristics of the conductive toner carrier is, supposing that di=0 and $V_i$=0 in equation (17), as follows.

$$mp = \frac{km}{A}\left(-\frac{V_o - V_b}{dt\rho_t} + \frac{dt}{2\epsilon t}\right) \quad (18)$$

Let us now consider the semiconductive roller. Let it be supposed that di=0 and $V_i$=0 in FIG. 2 and that there is a semiconductive layer with a resistor R inserted between the conductive layer and the developing bias power supply. In this case, considerations must be given to variations in the effective developing bias caused by a developing current.

In view of the fact that both toner particles and the surface of the electrostatic latent image holding body 6 covered by the development region are triboelectrified, a developing current I in the development of an entirely solid image is, by using $m_p$ of equation (18), is found as follows.

$$\begin{aligned} I &= I_p - I_r \\ &= -(q - q_p)m_p V_p l + q_p(km - m_p)V_p l \end{aligned} \quad (19)$$

Figure 3:
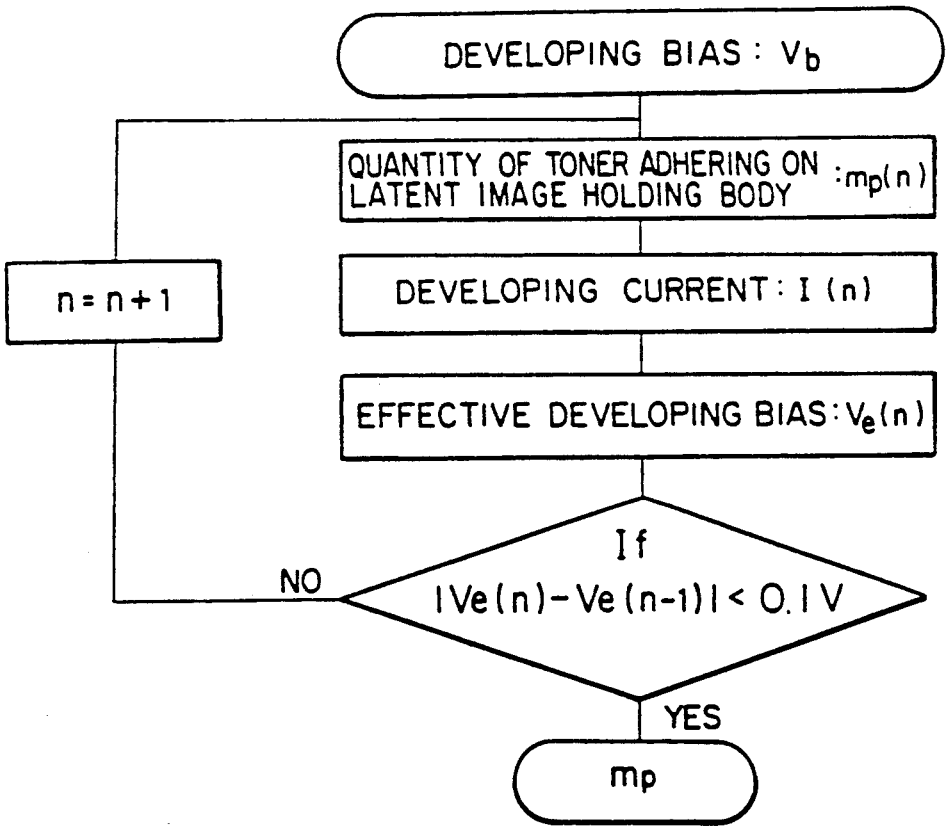
FIG. 3 is a flowchart showing a computer simulation that verifies the functions of the developing method according to the present invention.

The developing current I generates a potential difference across the resistor R, thereby making the effective developing bias $V_e$ to be as follows.

$$V_e = V_b + RI/S_r \quad (20)$$

where:

$I_p$: current caused by the adhesion of toner on the electrostatic latent image holding body;

$I_r$: current caused by toner remaining on the surface of the toner carrier q: quantity of electrification of toner that adheres to the surface of the electrostatic latent image holding body $q_p$: quantity of toner electrification due to triboelectrification with the surface of the electrostatic latent image holding body R: resistance of the toner carrier ($\Omega \cdot m^2$)

l: effective length of the toner carrier $S_r$: effective surface area of the toner carrier Variations in effective developing bias $V_e$ lead to variations in the quantity of developing toner $m_p$, which in turn leads to variations in $V_e$, thereby starting a cycle. It is supposed that the real quantity of developing toner is a value $m_p$ obtained when the $V_e$ variations converge into below 0.1 V by repeating the above cycle with a computer. A flowchart of this calculation is shown in FIG. 3.

Based on the aforesaid theory, the development characteristics of the respective three types of toner carrier are studied, and attempts were made to optimize the various developing parameters through the comparison of test data.

(1) DEVELOPMENT CHARACTERISTICS OF THE CONDUCTIVE TONER CARRIER

Figure 4:
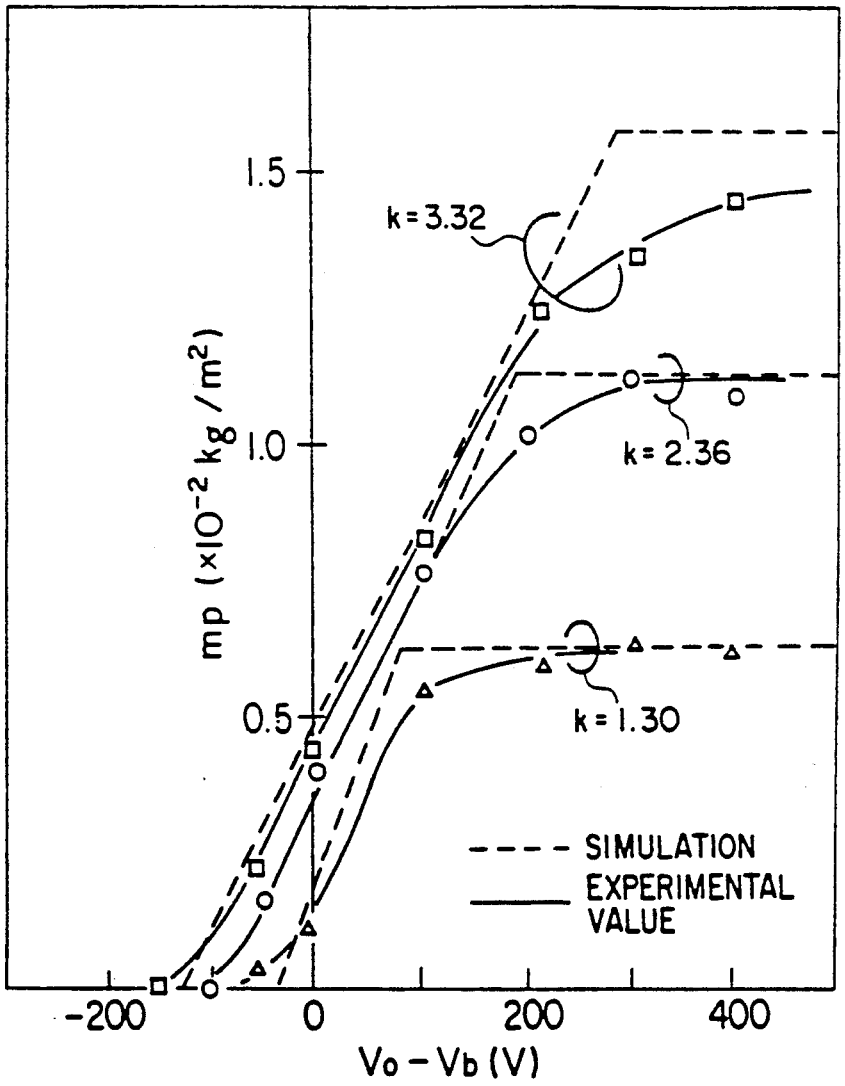
FIG. 4 is a diagram showing the development characteristics when a conductive toner carrier is used in the developing method according to the present invention.

The development characteristics f the conductive toner carrier is shown in FIG. 4. There is good consistency between theory and practice. In the analysis, it was hypothesized that the thickness of the toner layer in the development region does not depend on the velocity ratio k, and therefore the test values such as listed below were used. In the test, a toner carrier having a surface conductive layer of 63 $\Omega \cdot m^2$ was used.

$m = 4.8 \times 10^{-3}$ kg/m$^2$ $dp = 20.\ dt = 11.\ di = 50\ \mu m$ $\epsilon_p^* = 3.4.\ \epsilon_t^* = 1.2.\ \epsilon_i^* = 6.5$ $q = -1.10 \times 10^{-2}$ C/kg (at k = 1.30)

$q = -1.43 \times 10^{-2}$ C/kg (at k = 2.36)

$q = -1.55 \times 10^{-2}$ C/kg (at k = 3.32)

$V_o = -70\ V.\ l = 0.2$ m $V_p 3.93 \times 10^{-2}$ m/sec $S_r = 1.13 \times 10^{-2}$ m$^2$ $q_p = -0.2 \times 10^{-2}$ C/kg

(2) DEVELOPMENT CHARACTERISTICS OF THE SEMICONDUCTIVE TONER CARRIER

Figure 5:
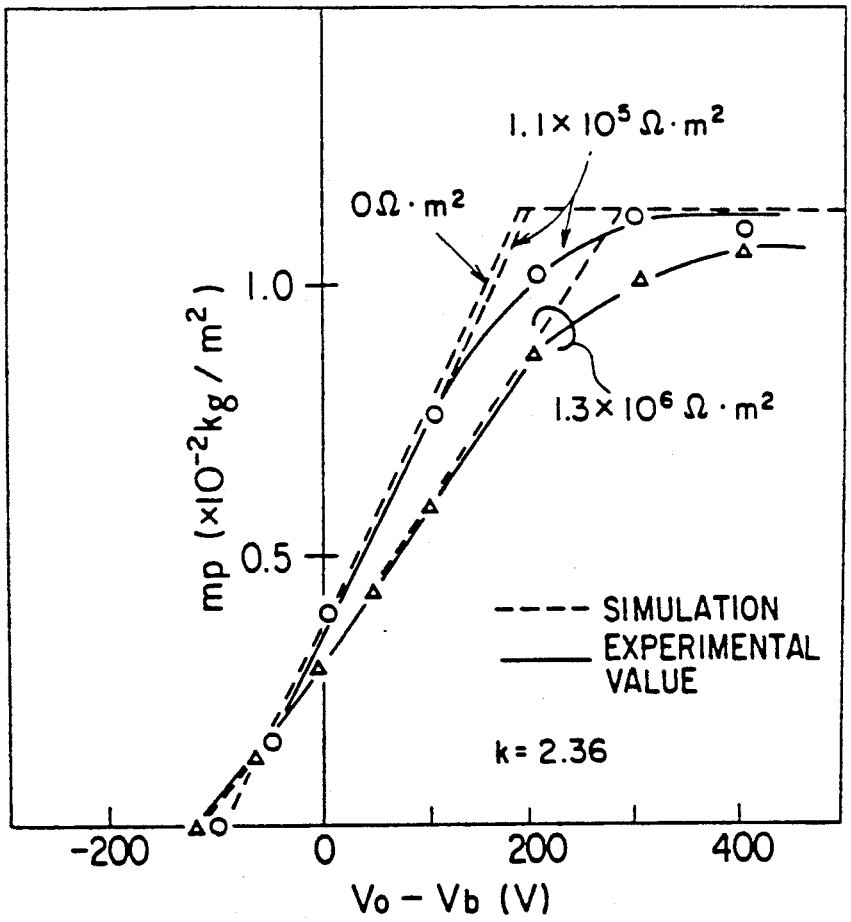
FIG. 5 is a diagram showing the development characteristics when a semiconductive toner carrier is used in the developing method according to the present invention.

The development characteristics of the semiconductive toner carrier is shown in FIG. 5. As is apparent from this figure, there is little resistance-dependent difference in its characteristics as far as the electric resistance R of the toner carrier is below $1.1 \times 10^5\ \Omega \cdot m^2$. However, once the resistance is in excess of this value, there is a tendency that a value (inclination of the characteristic curve) starts to decrease.

Figure 6:
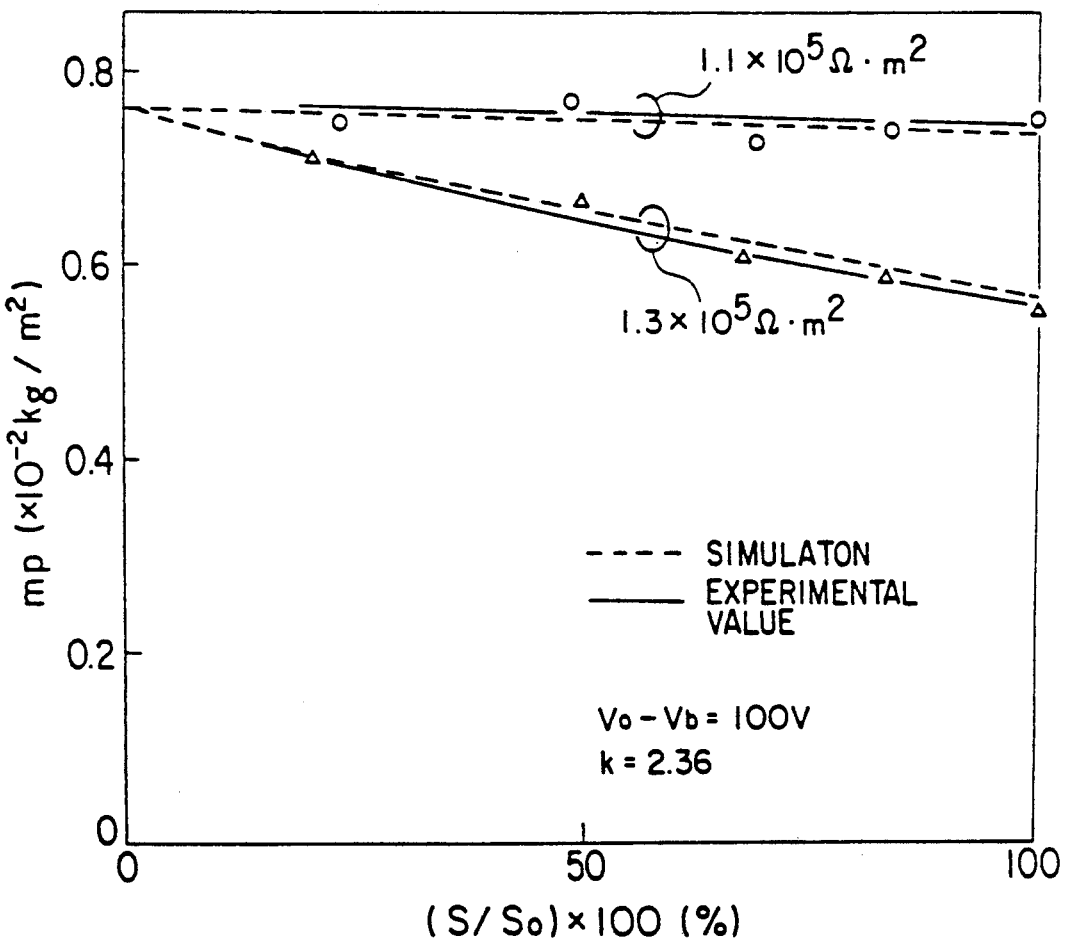
FIG. 6 is a diagram showing the relationship between an electrostatic latent image area on the surface of an electrostatic latent image holding body and the quantity of toner that adhered per unit area when the developing unit employs the semiconductive toner carrier in the developing method according to the present invention.
Figure 7:
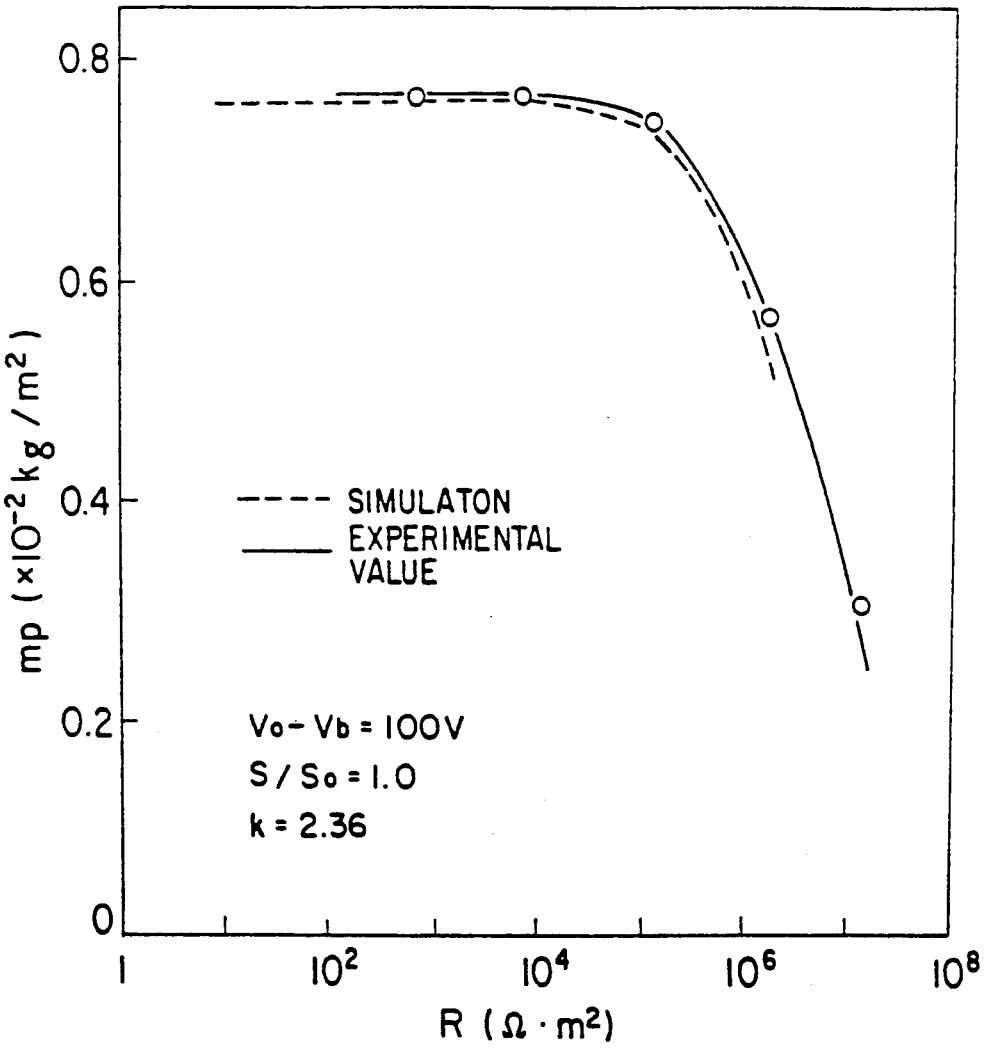
FIG. 7 is a diagram showing the relationship between the electric resistance of the toner carrier and the quantity of toner that adhered on the surface of the holding body of an electrostatic latent image for entire solid development.

Here, it should be noted that the quantity of developing toner $m_p$ per unit area varies depending on the ratio ($S/S_o$) of an image portion area to the entire latent image at a developing position as shown in FIG. 6. FIG. 7 shows the relationship between the quantity of developing toner and the resistance R of the toner carrier for an entire solid development (i.e. $S/S_o = 1$). As is apparent from this figure, resistances in excess of $1 \times 10^5\ \Omega \cdot m^2$ cause a drastic reduction in image density. Furthermore, an evaluation of the image quality indicated that the decrease in the density of the image was distinctly visible at a resistance of $1.5 \times 10^6\ \Omega \cdot m^2$, whereas not with a resistance of $1.1 \times 10^5\ \Omega \cdot m^2$. Therefore, the resistance R of the toner carrier should be smaller than $1.5 \times 10^6\ \Omega \cdot m^2$; or more preferably, $R \leqq 1.1 \times 10^5\ \Omega \cdot m^2$.

The resistance R of the toner carrier used in a first developing method according to the present invention will now be defined. Although the specific resistance $\rho$ is generally used as the resistance of a substance, the product $\rho \cdot le$ (=R) of the specific resistance l and the thickness le of the elastic body layer is used as a parameter of roller governing the actual development characteristics. In practice, the toner carrier has an electrode of an area S in contact with the peripheral surface thereof and an ammeter is connected to this electrode. From a current (I) measured upon application of a voltage of 10 V to the shaft, not only a resistance $R_o$ (= 10/I) is calculated but also a resistance R is obtained by using the equation $R = R_o \cdot S$. Using a generally known definition of resistance:

$$R_o = \rho \cdot le/S$$

it is understood that the resistance $R(=\rho \cdot le)$ of the toner carrier may be calculated as $R_o \cdot S$ since $R_o \cdot S = \rho \cdot le$.

Figure 8A:
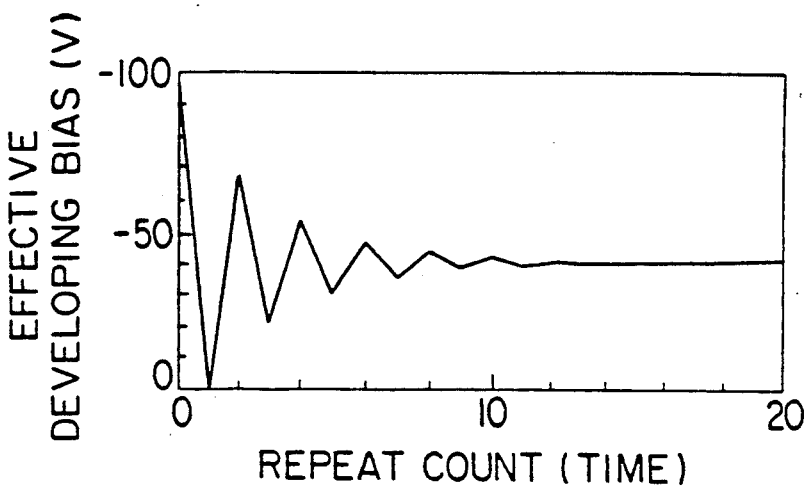
FIG. 8 is a diagram showing the relationship between the repeat count for the loop in the flowchart shown in FIG. 3 and the actual bias value when the semiconductive toner carrier is used in the developing method according to the present invention.
Figure 8B:
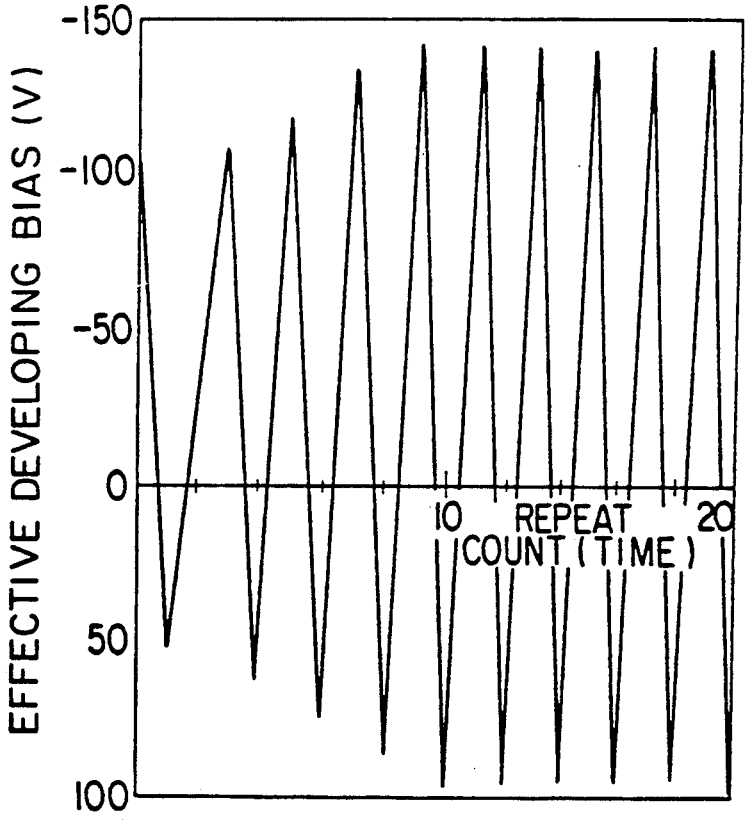

The result of the simulation based on the flowchart shown in FIG. 3 will be discussed in more detail. The flowchart indicates that the effective bias will be converged when the loop of calculating the effective developing bias is repeated by n = n + 1. FIG. 8 is a diagram plotting these calculation results with the repeat count n on the horizontal axis. Part (a) of FIG. 8 shows the result with $R = 1.5 \times 10^6\ \Omega \cdot m^2$, whereas part (b) of FIG. 8 with $R = 3.0 \times 10^6\ \Omega \cdot m^2$, where $V_o = 0$ V. Part (b) of FIG. 8 exhibits divergence of the effective developing bias, indicating that the resistance is in a range that demands an observation from the viewpoint of the theory of transient phenomenon. Part (a) of FIG. 8 shows a variation in the effective developing bias in a first loop between −100 V, an initial value, to approximately 0 V. From these results, the aforesaid requirement as to the resistance of the toner carrier, $R < 1.5 \times 10^6\ \Omega \cdot m^2$, is further generalized to be as follows.

$$-100 < \{-(q - q_p)m_p V_p l + q_p(km - m_p)V_p\} \cdot R/S_r < 100$$

In other words, the absolute value of $RI/S_r$ in equation (20) should be below 100 V. This is the requirement for consistently producing a satisfactory image with high density.

(3) DEVELOPMENT CHARACTERISTICS OF THE DIELECTRIC TONER CARRIER

Figure 9:
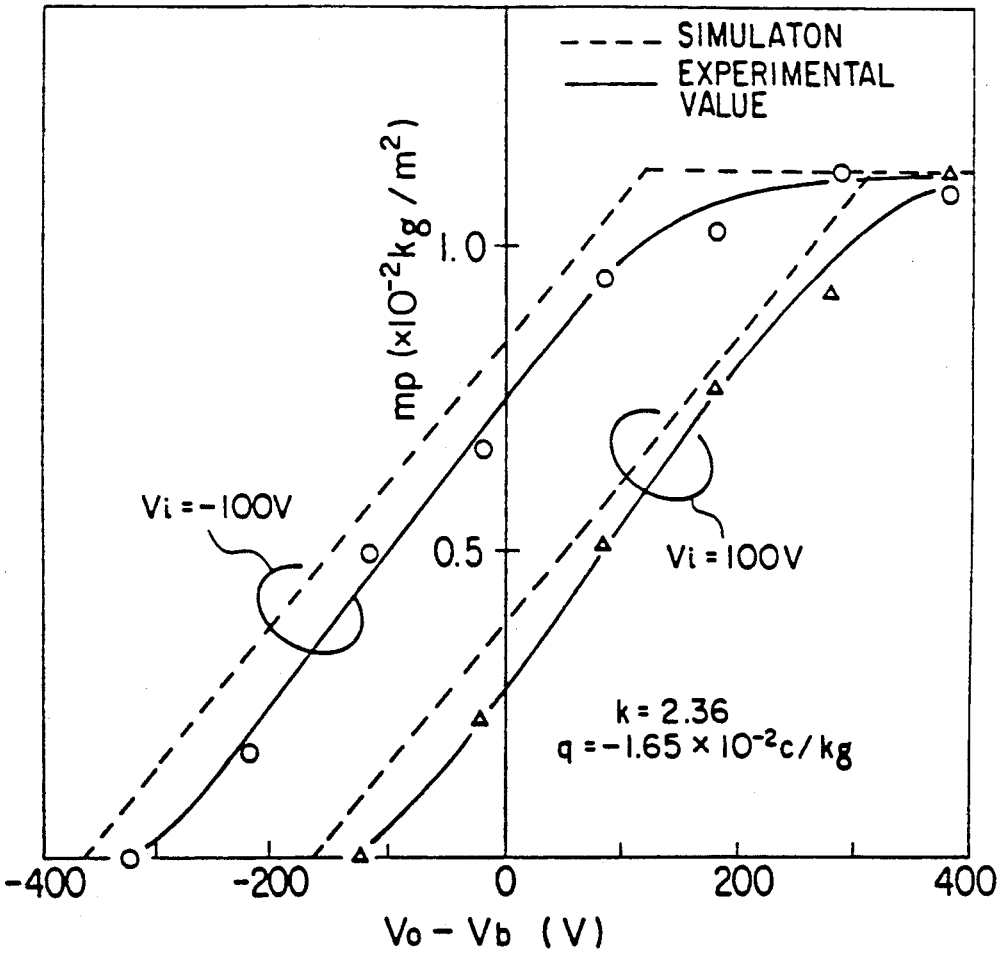
FIG. 9 is a diagram showing the development characteristics when the dielectric toner carrier is used in the developing method according to the present invention.

FIG. 9 shows the development characteristics of the dielectric toner carrier, and this indicates both the feature that the value of development can be controlled by such factors as the thickness and the dielectric constant of the dielectric body layer and the problem that the development characteristics vary depending on variations in the surface potential of the toner carrier attributable to triboelectrification with the toner. Therefore, it is necessary, in practical applications, to provide means for stabilizing the surface potential of the dielectric body layer. In the test a toner carrier having a dielectric body layer of 50 μm arranged over the surface of a conductive elastic body layer of 28 $\Omega \cdot m^2$ was used.

From the above observations it was demonstrated that a stable and high density development characteristics could be obtained by specifying the resistance of the toner carrier to below $1.5 \times 10^6\ \Omega \cdot m^2$.

In practice, 1) a resistance of $1 \times 10^4$ or $1.5 \times 10^6\ \Omega \cdot m^2$ is required if dielectric breakdown of the electrostatic latent image holding body must be prevented;

2) it is not easy to manufacture semiconductive elastic toner carriers having resistances within the above range with good reproducibility; and 3) it can be said that the most effective method is to apply a developing bias through a protective resistor (approximately 1 to 100 MΩ) that is equivalent to $1 \times 10^4$ to $1.5 \times 10^6\ \Omega \cdot cm^2$ with the surface layer of the toner carrier being made of a conductive layer whose resistance is less than $1.5 \times 10^6\ \Omega \cdot cm^2$ in consideration of the fact that the semiconductive toner carrier according to this invention is equivalent to a conductive toner carrier having a resistor interposed between its surface conductive layer and developing bias power supply.

Embodiments of the developing method according to the present invention will next be described in more detail with reference to FIG. 10.

Figure 10:
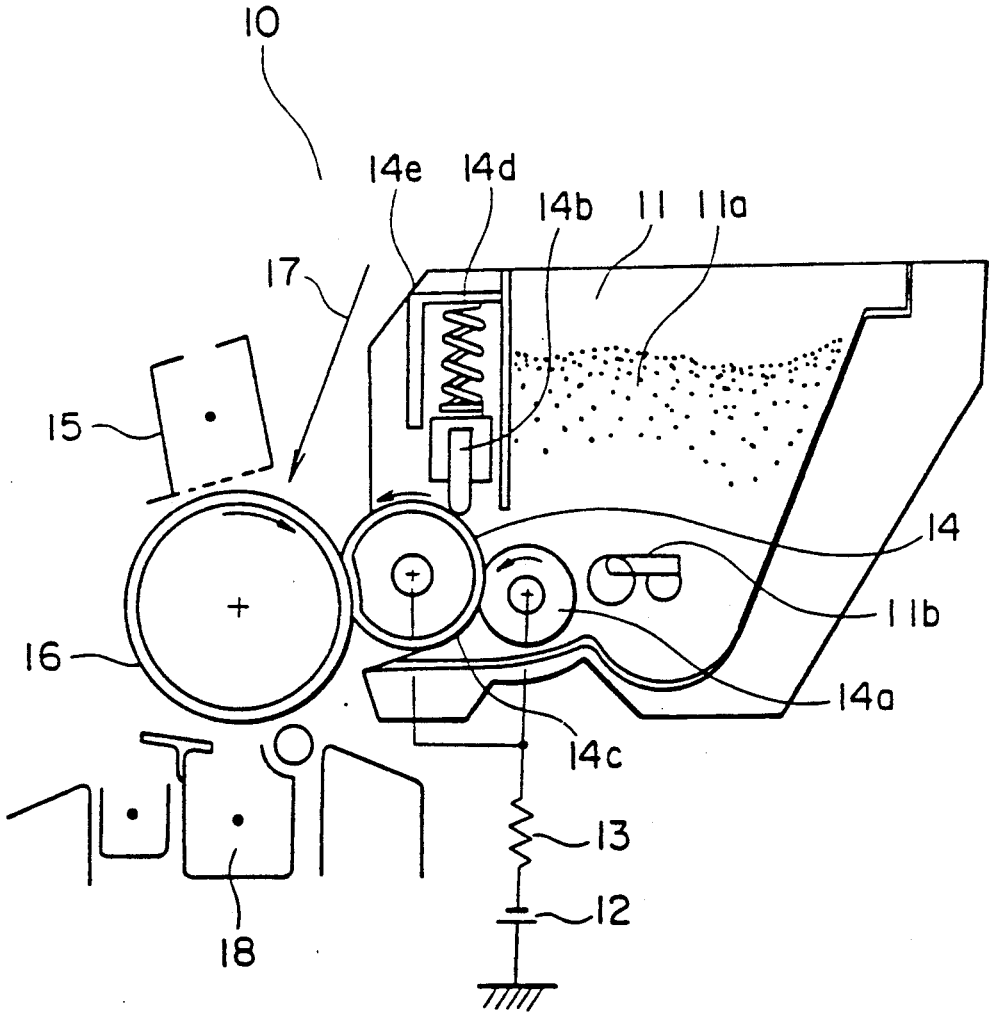
FIG. 10 is a sectional view showing the main portion of a developing unit employed for the embodiment of the developing method according to the present invention.

FIG. 10 is a sectional view showing the main portion of a developing unit used for embodying the method according to the present invention. The developing unit 10 comprises: a toner container 11 in which a single component toner 11*a* is contained; a toner supplying roller 14*a* for supplying the single component toner 11*a* to a toner carrier 14; a toner layer thickness regulating member 14*b* for forming a uniform toner layer on the surface of the toner carrier 14 by regulating the supplied toner; an electrostatic latent image holding body (photosensitive drum) 16 which confronts with the toner carrier 14 rotating while carrying the toner layer and renders visible an electrostatic latent image formed and held on the surface thereof; a recovery blade 14*c* for recovering the toner remained after development into the toner container 11; a stirring member 11*b* for stirring the toner 11*a* in the toner container 11; and a spring 14*d* for pressing the toner layer thickness regulating member 14*b* on the surface of the toner carrier 14 with a predetermined load.

In FIG. 10, reference numeral 15 designates a charger for electrostatically charging the photosensitive drum 16 serving as a latent image holding body to a predetermined level; 17, exposure means for forming a predetermined latent image on the surface of the photosensitive drum 16; 18, a transferring unit for transferring the electrostatic latent image on the photosensitive drum 16 formed into a visible image by development to a supporting body such as paper; 12, a dc power supply for supplying a predetermined current to the toner carrier 14 and the toner supplying roller 14*a*; and 13, a protective resistor.

Components of the developing unit thus constructed will be described. The toner carrier 14 may be constituted by such metals as aluminum and stainless or such resins as phenol resin, acrylic resin, urethane resin, fluorine-contained resin, polyamide resin, silicon resin, melamine resin, polystyrene resin, polyester resin, epoxy resin, and their compounds. A body containing magnetic poles inside may also be used. In the present embodiment, an elastic and conductive toner carrier 14 which is nonmagnetic (or not magnetized) will be illustrated as an example. The elastic and conductive toner carrier 14 may preferably have a conductive rubber layer (whose resistance is made less than $1.5\times10^6\ \Omega\cdot m^2$ by dispersing conductive carbon or metal particles into such rubber as urethane rubber, silicon rubber, ethylene-propylene rubber, butadiene-acrylonitrile rubber (NBR), chloroprene rubber, and butyl rubber) arranged around its shaft; and silicon resin, urethane resin or fluorine-contained resin further coated on the conductive rubber layer; a conductive resin coated on the surface of a high resistance or insulating rubber roller; or a conductive layer arranged on the surface of a semiconductive rubber roller (whose resistance is less than $1.5\times10^6\ \Omega\cdot m^2$). In this Specification, a case where an elastic and conductive toner carrier which is made of an EPDM rubber roller (whose hardness is 30 degrees in Japanese Industrial Standard type A) with a coating of conductive urethane over its surface and which has a resistance between the metal shaft and the coating surface so adjusted as to be less than $1.5\times10^6\ \Omega\cdot m^2$ will be described. The external diameter of the metal shaft was 8 mm, that of the rubber roller 18 mm, and the thickness of the conductive urethane coating was 20 to 200 $\mu$m.

The technique of developing an electrostatic latent image includes one in which toner particles are scattered by the developing electric field while maintaining the surface of the electrostatic latent image and that of the toner carrier 14 noncontact, and one in which both electrostatic latent image and the toner carrier are brought into contact and then rotated or slid for development. Although the developing method according to the present invention may be applied to both techniques, the case where the surface of the electrostatic latent image of the electrostatic latent image holding body 16 is brought into contact with that of the toner carrier 14 will be discussed here. In the noncontact type development technique, the quantity of charges $q_p$ stored by the toner through its triboelectrification with the surface of the electrostatic latent image holding body 16 is zero.

The toner layer thickness regulating member 14*b* is made up of a platelike high polymer whose tip is formed into a cylindrical surface or a curving surface (a cylindrical to curving surface) and whose rubber hardness is 30 to 100 degrees. The tip is abutted against the surface of the toner carrier 14 by a pressing force applied from the spring 14*d*. The profile of the end part of the regulating member 14*b* being either a circular arc or a curve provides the effect that is intermediate between the effect of pressuring the middle part and that of pressuring the sharp edge. Therefore, this allowed not only a thin layer of toner to be formed into a desired condition with a comparatively small pressuring force but also the toner particles to be properly triboelectrified. Satisfactory results were obtained with a toner layer thickness regulating member 14*b* having a tip of cylindrical surface or curving surface whose radius is 0.1 to 20 mm, or more preferably, 0.5 to 10 mm.

An image was developed under the following parameters: a surface potential of the electrostatic latent image holding body (photosensitive drum) 16 is −500 V; an output voltage of the developing bias power supply 12 is −200 V; a resistance of the protective resistor 13 is 10 MΩ; and other developing parameters are the same as referred to in the descriptions of the basic arrangement and functions. The result was a highly satisfactory uniform, high density image without fog.

As is clear from the foregoing descriptions of both arrangement and functions as well as the embodiment of the developing method according to the present invention, it is extremely easy to set developing parameters for obtaining a satisfactory image and to consistently produce acceptable developed images according to this invention. Unlike the past experience of not having been able to obtain satisfactory images by the prior art developing method using different values proposed as an appropriate volume resistivity of the toner carrier, the present invention provides a practicable developing method that allows high-definition developed images to be consistently produced with ease by adjusting critical developing parameters as integrally studied.

Although the nonmagnetic, single component toner was used in the above first embodiment, it goes without saying that the method according to the present invention may be applied to a development technique using a magnetic toner. Furthermore, although the elastic roller was exemplified as the toner carrier in the above embodiment, an appreciable advantage will of course be obtained in the case where a hard toner carrier made of a metal or a resin is employed.

Embodiment 2

Another embodiment of the developing method according to the present invention will next be described.

In a first developing method according to this embodiment, part of the nonmagnetic toner thin layer is left on the surface of the toner carrier after the development has been completed within the prescribed range of developing parameters, whereas in a second developing method, a value of $(vt/vi)\cdot m_1$ is varied, depending upon the type of the latent image and within the prescribed range of developing parameters, where vt is the speed of movement of the toner carrier, vi is the speed of movement of the latent image, and $m_1$ (mg/cm$^2$) is the quantity of toner that adheres on the surface of the toner carrier before development.

More specifically, the feature of the developing method according to the present invention is in that part of the nonmagnetic toner thin layer is left on the surface of the toner carrier after the development has been completed and this remaining toner encourages new nonmagnetic toner particles to adhere, thereby significantly improving the toner transferability (by "calling them in").

It is not all clear why the remaining toner contributes to the improvement of toner transferability, but the remaining toner gets its triboelectrified charge to induce a charge of opposite polarity (a so-called "image charge") on the surface of the toner carrier, and an image force derived from the induced charge causes the remaining toner to firmly adhere to the surface of the toner carrier. Therefore, it is assumed that the remaining toner scoops up the new nonmagnetic toner particles from the toner container, thereby contributing to improving the toner transferability. Further, in the case where a nonmagnetic toner thin layer is formed by pressing the nonmagnetic toner layer thickness regulating member on the surface of the toner carrier, the remaining toner helps provide a clearance between the regulating member and the toner carrier as it passes through against the pressing force coming from the regulating member to thereby facilitate new nonmagnetic toner particles to pass through against the pressure. Thus, the toner transferability is appreciably ameliorated.

Even in the case where the quantity $m_1$ (mg/cm$^2$) of toner that adheres to the toner carrier before development is small, it is possible to increase a supply of toner $(vt/vi)\cdot m_1$ to the latent image by increasing the speed ratio vt/vi of the toner carrier to the latent image, thereby allowing a desired high density image to be produced. Although it is possible to achieve a high density development by increasing $m_1$ by changing either the toner layer thickness regulating member itself or its preset parameters, thoughtless increases in $m_1$ may result in generation of fog, so that it is preferable that any increase in $m_1$ should be accompanied by an increase in vt/vi.

Especially an increase in $(vt/vi)\cdot m_1$ may provide an image with excellent contrast if a solid development area is wide. Conversely, in order to produce an image consisting of line images such as characters, $(vt/vi)\cdot m_1$ should be decreased to reduce the quantity of toner to adhere to the latent image. A sharp image is thereby produced. A change in $(vt/vi)\cdot m_1$ may be realized by, e.g., adjusting either the speed of rotation of the motor or preset parameters of the toner layer thickness regulating member by operating switches or controls based on the judgment of the user, or by detecting with either optical or electric means the ratio of a solid image area or a line image area in the entire image to be produced to thereby cause it to be changed automatically in accordance with predetermined criteria that have been programmed. Accordingly, even in the developing method using a nonmagnetic thin layer of toner, it is possible to perform image density control over an extremely wide range.

As a more important function or advantage mention should be made to the fact that adjustment in $(vt/vi)\cdot m_1$ allows the aforesaid toner transferability to be controlled. That is, when an image consisting mainly of line images such as characters is to be produced, the toner is not to be consumed so much as to impair the toner transferability. Therefore, $(vt/vi)\cdot m_1$ can be confined to a small value to thereby produce the image with sharper lines. On the other hand, when an image consisting mainly of solid images is to be produced, $(vt/vi)\cdot m_1$ must be increased to increase not only a supply of toner to the latent image but also the remaining toner on the toner carrier after development, thereby contributing to improving the toner transferability as well as to preventing a reduction in image density. The adjustment of $(vt/vi)\cdot m_1$ may be made either manually or automatically. In automatic control, it is suggested that the type of image to be produced, i.e. whether the latent image subject to development is a line image or solid image, be detected.

A more specific example of a developing method using a developing unit of similar arrangement shown in FIG. 10 will next be discussed.

In this embodiment, a case where a latent image with a potential at an unexposed portion $V_0$ of the electrostatic latent image holding body 16 being −500 V and a potential at an exposed portion $V_1$ being −50 V is subjected to adhesion to the toner by a reversal process will be illustrated. More specifically, a potential at the background portion and that at an image portion correspond to $V_0$ and $V_1$, respectively. The conductor layer of the toner carrier 14 has a developing bias voltage $V_2$ applied. In this embodiment, the standard parameters are: $V_2=-200$ V; vt=80 mm/sec; a photosensitive body surface speed vi=40 mm/sec; a contact width between the photosensitive drum 16 and the toner carrier 14 is 2 to 3 mm; and a toner 11*a* of negatively charged single component nonmagnetic type composed of such a material as styrene-acrylic resin, carbon black, antistatic agent, wax, or hydrophobic silica. The evaluation of the image quality was based on a method by which toner image was fixed by a laser printer LB-1305 manufactured by Tokyo Electric on a sheet of paper specified for use in PPC manufactured by Toshiba, and the density of the fixed toner image was measured by a Macbeth reflection type densitometer RD-918. The laser printer used was a modification of a developing unit into the one shown in FIG. 10 for single component nonmagnetic development.

Furthermore, the transferability of toner was evaluated by a method in which both an image density D of the front end of and that D′ of the tail end of a solid image that covered entirely an A4 paper were measured and it was judged as satisfactory when D—D′ was below 0.2 and as defective when it was above 0.2. Let it be supposed that a quantity of toner that adheres to the surface of the toner carrier before development is $m_1$ (gm/cm$^2$); a quantity of toner among $m_1$ that is transferred to the surface of the latent image by development is $m_2$ (gm/cm$^2$); and a quantity of toner that remains on the surface of the toner carrier after development is $m_3$ (gm/cm$^2$); and these values were measured in the following three manners.

a) The toner on the surfaces of the toner carrier 14 and the electrostatic latent image holding body 16 was sampled using an adhesive tape (Scotch mending tape 810), and the values $m_1$, $m_2$ and $m_3$ were calculated by converting the sampled areas and weights.

b) The difference in weight before and after the adherence of toner on the electrostatic latent image holding body 16 was measured after development to calculate $m_1$ and $m_2$ and to further obtain $m_3$ out of the relationship, $m_3=m_1-m_2$. The value $m_1$ must, however, be measured under the condition that the developing electric field is increased so that the toner layer can completely be transferred to the electrostatic image holding body 16.

c) The toner layer on the toner carrier surface is adsorbed into a cyclone by air and the absorbed toner is weighed to thereby calculate $m_1$ and $m_3$ and then obtain $m_2$ based on the relationship, $m_2=m_1-m_3$.

The values measured by any one of the above three manners are so close to one another that any value may be used in the test.

The correlation between the value $m_2/m_1$ or $m_3/m_1$ and the toner transferability (D—D') was first analyzed. While adjusting $m_1$ to be within 0.4 to 0.6 (mg/cm$^2$), $m_2$ and $m_3$ were varied by randomly changing the developing voltage $V_1-V_2$. The following results were obtained. The value D—D' was below 0.2 when $m_2/m_1 \leqq 0.9$, whereby the toner transferability was satisfactory. The value D—D' exceeded 0.2 when $m_2/m_1 \geqq 0.9$, whereby the transferability was extremely poor. Taking variations in other developing parameters into consideration, it is more preferable that $m_2/m_1$ should be adjusted to below 0.8 on a practical level. When using the value $m_3/m_1$, a better transferability can be obtained when $m_3/m_1 \geqq 0.1$, or preferably $m_3/m_1 \geqq 0.2$. In expressing this in terms of absolute value of the quantity of toner $m_3$ that remains on the surface of the toner carrier 14 after development, it can be said that a satisfactory toner transferability is obtained when $m_3$ is above 0.04 (mg/cm$^2$), or preferably above 0.08 (mg/cm$^2$).

As described above, according to this embodiment, it is possible to prevent deterioration or reduction in the transferability of toner, thereby allowing a consistent, high density, satisfactory image to be always obtained.

Embodiment 3

This embodiment refers to the correlation between the quantity of toner to be supplied to a unit area (1 cm$^2$) on the surface of a latent image, i.e. $(vt/vi)\cdot m_1$ and the transferability of toner. It was found that since a supply of toner that amounts to 0.58 to 0.63 mg per 1 cm$^2$ of the latent image is required for obtaining an image whose density is above 1.0, parameters such as vt, vi and $m_1$ must be adjusted so as to satisfy the relationship $(vt/vi)\cdot m_1 \geqq 0.7$ in order to satisfy the condition $m_3/m_1 \geqq 0.1$. Under this condition, it is possible to set the initial image density to above 1.0 and D—D' to below 0.2 so that a uniform and high density solid image can always be produced.

If $(vt/vi)\cdot m_1$ is large, not only a larger quantity of toner can be supplied through the latent image but also a larger quantity of toner can be left on the surface of the toner carrier 14. Therefore, it is desired that $(vt/vi)\cdot m_1$ is adjusted to a larger value to improve the toner transferability.

In the developing unit so constructed as shown in FIG. 10, the toner carrier 14 is driven by a motor (not shown). The speed of rotation of the motor is, as is known well, is easily variable by changing the constant in its control circuit. Thus, it will be possible to improve the toner transferability, image density, and sharpness by changing $(vt/vi)\cdot m_1$ through adjustment of the speed of movement vt of the toner carrier 14. Especially, in the case where an image to be produced consists mainly of a solid portion and it is likely that large quantities of toner will have to be consumed by development, a high density developed image that suffered no defective toner transferability can be produced by causing a user to select the speed of rotation of the motor with a switch or volume mounted on a copying machine or printer to thereby increase $(vt/vi)\cdot m_1$. There was a limit in the prior art method of adjusting the density by the quantity of exposure or by the developing bias, because when the thin layer of toner on the surface of the toner carrier completely adhered to the surface of the photosensitive body 16, no further improvement in density was possible. However, in the method according to the present invention, such improvement in density can be achieved, in principle, limitlessly by increasing $(vt/vi)\cdot m_1$, and no reduction in density attributable to defective toner transferability will result. On the other hand, when an image to be produced consists mainly of line images such as characters and it is likely that no large quantities of toner will have to be consumed, the speed of the motor for driving the toner carrier 14 is decreased to prevent obscured detail of character image due to excessive development and to thereby produce a sharp image.

A unit for producing a desired image based on image data that have been converted into an electric signal, such as a laser beam printer, an LED printer, a liquid crystal printer, an ionographic printer, an electrostatic recorder and a copying machine that uses any of these devices may be constructed so that an image to be produced is automatically analyzed to find the ratio of a solid image portion to the entire image, and the speed of rotation of the toner carrier 14 is adjusted according to such ratio. The unit thus constructed may provide a consistently uniform, high density solid image and sharp line images.

This unit will be described in more detail with reference to the developing unit shown in FIG. 10. Let it be supposed that circumferential speeds of the electrostatic latent image holding body (photosensitive drum) 16 and the roller-type toner carrier 14 are vi, vt, respectively, and the external diameter of the roller-type toner carrier 14 is d. When a length of a solid image that is included in an image to be produced (the length measured in the circumferential direction of the photosensitive body surface, or in the forwarding direction of the paper in terms of the image transferred onto the paper) satisfies the relationship $l<\pi d\cdot(vi/vt)$, there will be no reduction in density due to defective toner transferability. It is because the length of a solid image corresponding to one full rotation of the toner carrier 14 is equal to $\pi d\cdot(vi/vt)$ in the produced image, and the value l being smaller than this means that the toner transferability is not defective. Thus, when there is a solid image satisfying the relationship $l \geqq \pi d\cdot(vi/vt)$, defects in toner transferability may be prevented by increasing $(vt/vi)\cdot m_1$ by the aforesaid technique. In a device which employs a modulated electric signal to produce an image, the image data is automatically analyzed to find the parameter l, and $(vt/vi)\cdot m_1$ can be varied according to that parameter. In a so-called analog type copying machine which produces an electrostatic latent image by forming the image out of the light reflected from a material to be copied on the surface of the photosensitive drum 16, and then develops and copies it, automatic detection of the value l is not easy. Therefore, in this case, the speed of rotation of the toner carrier may be adjusted either manually on the basis of user judgment or preference, or $(vt/vi)\cdot m_1$ may automatically be changed by detecting the intensity of the light reflected from the material.

Although the technique of changing $(vt/vi)\cdot m_1$ mainly by changing the parameter vt was described in the foregoing, it may also be possible that $m_1$ is made variable to control $(vt/vi)\cdot m_1$. In this case, an effective technique is to make variable a pressing force P of the toner layer thickness regulating member 14*b* on the toner carrier 14. More specifically, a load regulating member 14*e* for determining the length of the spring 14*d* that applies a load to the toner layer thickness regulating member 14*b* in the unit shown in FIG. 10 is made movable vertically, and $m_1$ may be changed in the range of approximately 0.1 to 1.2 ($mg/cm^2$) by causing the load regulating member 14*e* to be properly positioned in the vertical direction by a drive means (not shown).

According to the developing method in this embodiment, the supply of toner to the latent image $(vt/vi)\cdot m_1$ is varied according to the type of image to be produced, especially, the length of the solid image, whereby the image density can arbitrarily be varied in an extremely wide range, and at the same time, sharper line images can thus be produced. Any increase in the supply of toner to the latent image $(vt/vi)\cdot m_1$ helps cause larger quantities of toner to remain on the toner carrier after development, thereby allowing the toner transferability to be improved. Moreover, the appropriate adjustment of vt according to the type of image may provide enormous advantages such as of not rubbing the surface of the toner carrier more than necessary, and thus eventually increasing the life of the toner carrier.

Embodiments 4 to 10 of a first developing unit to which the developing method according to the present invention is suitably applied will next be described.

Basic features of the first developing unit are as listed below.

Since its toner carrier (developing roller) is constituted of an elastic conductive roller whose compression set is below 20%, the developed image quality does not deteriorate due to deformation of the toner carrier. Thus, a high-definition image can be maintained even if the developing unit is used for a long time or after being left unused for a long time.

The adjustment of surface roughness of the toner carrier base to below 20 μm Rz (JIS B0601) and below 50 μm Rmax (JIS B0601) also allows the elastic conductive roller (toner carrier) to be manufactured both inexpensively as well as easily, with the additional advantage that a developing unit capable of producing high quality images can be obtained.

Such an arrangement that the surface roughness of the toner carrier is maintained at below 10 μm Rz (JIS B0601) even after a predetermined abrasion test keeps the surface of the toner carrier less subject to damages when the developing unit has been used for a long time, thereby allowing high image quality to be maintained.

Furthermore, such an arrangement that the resistance of the toner carrier is maintained at below $10^7$ $\Omega\cdot cm^2$ after a predetermined abrasion resistance test, the produced image is not affected by the ratio of a white portion to an image portion of the image, thereby allowing high image quality to be maintained.

Furthermore, the fast integration of the toner carrier base with the conductor layer at a peel strength of above 20 g/mm helps prevent the surface layer of the developing roller from coming off, thereby allowing high image quality to be maintained.

Embodiment 4

An embodiment will hereunder be described with reference to the accompanying drawings.

Figure 11:
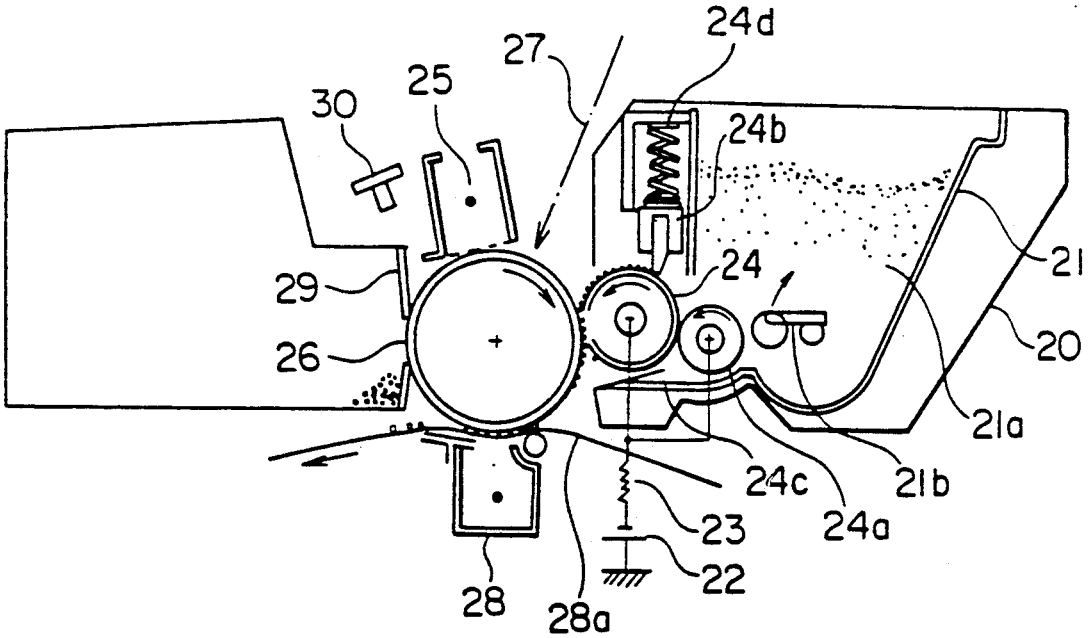
FIG. 11 is a sectional view showing an arrangement of main components of the developing unit according to the present invention.

FIG. 11 sectionally shows the construction of the main portion of the first developing unit according to the present invention. A developing unit 20 comprises: a toner container 21 for containing a single component toner 21*a*; a toner supplying roller 24*a* for supplying the single component toner 21*a* on a toner carrier (developing roller) 24; a toner layer thickness regulating member (coating blade) 24*b* for forming a toner layer of substantially uniform thickness on the toner carrier 24 by regulating the supplied toner; an electrostatic latent image holding body (photosensitive drum) 26 which confronts with the toner carrier 24 rotating while supporting the toner layer and which forms a visible image out of an electrostatic latent image on the surface thereof; a stirring member 21*b* for stirring the toner 21*a* within the toner container 21; a spring 24*d* for pressing the toner layer thickness regulating member 24*b* on the toner carrier 24 with a certain load; and the like.

Although the photosensitive body of the electrostatic latent image holding body 26 may be made of either selenium, cadmium salfide, zinc oxide, amorphous silicon or organic, an organic photosensitive body was used in this embodiment. The electrostatic latent image holding body 26 was first uniformly charged by a scorotron charger 25, exposed by an video-modulated light beam such as a laser beam 27, and was formed into a predetermined electrostatic latent image on the surface thereof. The electrostatic latent image thus formed was, as described previously, rendered visible by the developing unit 20 to form a toner image. The toner image thus formed was then transferred to a sheet of transfer paper 28*a* that is an image carrier by a transfer charger (transferring unit) and fixed by a fixing unit (not shown). The toner that remained on the surface of the electrostatic latent image holding body 26 was removed by such a member as a cleaning blade 29. Thereafter, the photosensitive body was subjected to an irradiation by a discharging lamp 30 and then charged again by the charger 25. This process was repeated.

The above process of forming a visible image out of a latent image by the developing unit 20, i.e. the principle of development, will now be described. Let it be supposed that a potential at the unexposed part out of a surface potential of the charged and exposed photosensitive body (electrostatic latent image holding body 26 is Vo, a potential at the exposed part is Vq, and a developing bias voltage to be applied to the toner carrier 24 by a dc power supply 22 through a protective resistor 23 is Vb. Let it also be supposed that the surface potential (effective developing bias) Ve of the toner carrier 24 is equal to the developing bias voltage Vb, and the electrostatic latent image is subjected to a reversal development by the negatively charged single component toner. In this reversal development, the effective developing bias Ve is generally adjusted so that it satisfies the relationship: $|Vo| > |Ve| > |Vq|$ (where Vo, Ve, Vq are all negative), and while the electrostatic latent image is developed by a potential difference $|Ve-Vq|$, the adhesion of toner to the non-image portion (defective adhesion of toner on a white portion, or a so-called "fog") is controlled by a potential difference $|Vo-Ve|$ to thereby effect a predetermined development process.

The arrangement or components of the developing unit 20 will next be described. First of all, the toner layer thickness regulating member 24*b* serves not only to regulate the quantity of toner that adheres to the surface of the toner carrier 24 but also to give triboelectric charges to the toner particles through triboelectrification, and therefore, it is made of a material susceptible to triboelectrification. Since the toner is charged negatively in this invention, such materials positioned in the positive side in the triboelectric series as silicone rubber, polyamide resin, melamine-formalin resin, polyurethane rubber, styrene-acrylonitrile copolymer, wool, quarts may preferably be used. Practically, it is advisable that a material which does not cause the toner to be solidified on the toner layer thickness regulating member 24*b* after a long period of use and which allows a uniform toner layer to be formed on the toner carrier 24 be used. The test results indicated that when silicone rubber of releasing type was used, there was no solidification of toner in a printing test of 100,000 sheets of A4 paper while providing a toner layer of consistently uniform thickness. It was ensured that the toner was negatively charged and no deterioration in image quality was exhibited.

There are several alternative arrangements and techniques of pressure contact of the toner layer thickness regulating member 24*b* such as pressuring the middle part of a flat plate, pressuring the edge part of a flat plate, or pressuring the flat end part of a flat plate, and they are all equally applicable to this developing unit. However, in the present embodiment, a technique of pressuring a circular arc end part was adopted. This technique not only allows a small optimal load applied by the toner layer thickness regulating member 24*b* and thus a small torque for driving the toner carrier 24 but also can maintain a uniform toner layer thickness and a uniform quantity of electrification of toner on the toner carrier 24.

The toner supplying roller 24*a* may be made, e.g., of a urethane foam having 100 cells per 25 mm. A urethane foam that is made conductive is preferable because it disengages electrostatic cohesion among toner particles and thus contributes to forming a more uniform toner layer. A brush roller or a rubber roller of low hardness may also be used. Thus, even if large quantities of toner must be consumed, e.g., to develop an entirely solid black image, the toner supplying roller 24*a* may serve to supply a predetermined quantity of toner with its contact depth of approximately 0.1 to 1.0 mm with respect to the toner carrier 24 and its speed of rotation that is adjusted to ¼ to 2 times the circumferential speed of the toner carrier 24.

Figure 12:
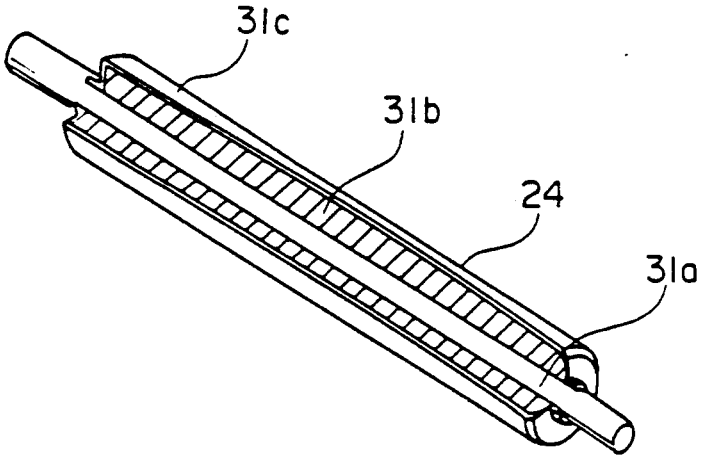
FIG. 12 is a perspective view showing an arrangement of a toner carrier used in the developing unit according to the present invention.

The toner carrier 24 will next be described. As shown in FIG. 12 in partially cutaway perspective form, the toner carrier 24 comprises a conductive shaft 31*a* which serves as a central axis and on which an elastic body layer 31*b* forming the elastic roller base and a flexible conductive layer 31*c* are arranged coaxially in the order written. The surface conductive layer 31*c* adjoins the shaft 31*a* as it is extended toward both ends of the toner carrier 24. The surface of the toner carrier 24 and the shaft 31*a* are electrically conducting.

In this embodiment, the aforesaid toner carrier 24 with a compression set of below 20% when measured by a predetermined measuring method was used. First, the method of measuring the compression set as prescribed in the present invention will be described with reference to FIG. 13. Compression set is defined in the Japanese Industrial Standards JIS K6301 with its measuring method. The profile of the test piece prescribed in the Standards is not identical with that for the present embodiment. Therefore, the measuring method employed in the present invention was one that is both closer to its actual application and simpler by using such a toner carrier as indicated below as a test piece. As described previously with reference to FIG. 11, the toner carrier 24 is under pressure applied by several components, and a long period of use or nonuse under such a condition will leave the deformation caused at the pressed parts irrecoverable, thereby leading to a so-called distortion. Any critical distortion does not allow a uniform toner layer to be formed there or otherwise cause variations i electric field generated between the toner carrier and the electrostatic latent image holding body (photosensitive drum) 26. These phenomena lead to deterioration in image quality, and in some worst cases, impairs the image with white stripes. It would be desirable that the developing unit 20 could measure these distortions; however, there still remains the problem of quantification (digitization) of such distortions. To this end, as shown in part (a) of FIG. 13, an accurately machined roller, such as a stainless steel roller 32, and the toner carrier 24 that is an object to be measured were juxtaposed at a predetermined distance and this distance was optically measured by an optical system 33. It should be arranged so that the distance between the centers of both components must be maintained at a predetermined value. Even after the object to be measured 24 has been removed, the distance between the two centers must be maintained at the same value as before the removal so that the distance between the same portions of both components could optically be measured without the object 24. In part (a) of FIG. 13, the external diameter of the toner carrier 24 was 20 mm and the distance between both centers was adjusted to 20.2 mm. If the object to be measured is accurately fabricated, the distance between both components should be measured as 0.2 mm. It is supposed that the thickness of the portion of the object to be measured 24 excluding the shaft is $t_o$ mm, which, in this case, was adjusted to 6 mm, with the external diameter of the shaft being 8 mm. Thus, knowing the external diameter of the shaft, the thickness of the object 24 can be measured.

Then, as shown in part (b) of FIG. 13, the portion in which the distance of the object 24 was measured (FIG. 13 (*a*)) was compressed with a jig 34. The compression method was as prescribed in the Japanese Industrial Standards JIS K6301; i.e. the object 24 was compressed to 25% of its thickness $t_o$, and held at 70° C. for 22 hours. The thickness in this case, $t_2$, was 4.5 mm. Then, by stopping compressing the portion and leave it for 30 minutes at ambient temperature, the distance of the compressed portion was measured optically as shown in part (c) of FIG. 13. In this case, care must be taken so that the distance between the two centers is maintained equal to that in part (a) of FIG. 13. If the distance measured is 0.3 mm, the thickness $t_1$ in this case is 5.9 mm. Thus, its compression set is calculated as follows.

$$\text{Compression set} = \frac{t_0 - t_1}{t_0 - t_2} \times 100(\%)$$

Therefore, since $t_0 = 6$, $t_1 = 5.9$ and $t_2 = 4.5$ in the above example, the solution obtained is 6.7%.

By the way, in this embodiment, the selection and adjustment of compression set of the toner carrier 24 to below 20% contributes to the prevention of deterioration in image quality due to the aforesaid distortion. However, it should be noted that the pressure applied by the toner layer thickness regulating member 24*b* is 10 to 100 g/cm$^2$. Taking variations in conditions such as in case of the largest pressing force into consideration, the compression set of the toner carrier 24 should preferably be adjusted to a value of below 10%. Although the temperature at the time of compression was set to 70° C. in the above example, this temperature gave allowance for temperatures during shipment and preservation. Therefore, even in the case where the object to be measured is held under temperatures higher or lower than this, this set temperature may be applicable to measurement under the present measuring method. The lowest temperature at which the inventor and his group made measurements was −20° C.

Although the inventor and his group had heretofore proposed that as for the toner carrier 24 which has a flexible conductor layer on the elastic body layer shown in FIG. 12, the compression set of the elastic body layer 31*b* that forms the roller base should be below 20%, it is newly proposed in this invention that the preferable compression set of the toner carrier 24 including the flexible surface layer should be below 20%, or more preferably below 10% as far as the toner carrier 24 is of such type of construction as shown in FIG. 12.

In explaining this difference, the tests conducted by the inventor and his group indicated that the image quality deteriorated even under a compression set of below 20% of the roller base 31*b*, and it was found that such deteriorations were not always caused by variations, e.g., of compression load to the toner carrier 24 but by the construction and material of the toner carrier 24. It was also found that the presence of the flexible layer 31*c* on the surface caused the compression set to either increase or decrease. The reason for a smaller compression set is explained by the fact that, when an elastic body having a flexible layer on its surface is compressed, the elastic body receives the compression load in a wider area, unlike the case of compressing an elastic body without any covering layer, and the deformation at this time does not stay at the area to which the load is applied but extends to other areas as well. As the manner of deformation between the most deformed and the least deformed is moderate, so is the effect of the distortion on the deterioration of image quality. That is, the toner carrier 24 is made less susceptible to sharp breakage and dents when a permanent distortion occurred thereto.

The reason for a greater compression set is that the surface layer 31*c* itself is distorted or that the surface layer 31*c* is deformed by heat and the like. In this case, the compression set of the elastic body layer 31*b* was reduced to below 10%, or more preferably to below 7% to thereby adjust the compression set of the toner carrier 24 to below 20%. As is clear from the foregoing, the elastic body layer 31*b* is not the sole factor in judging the influence of distortion on the image quality, and therefore, it is recommended that the distortion of the toner carrier as a whole be taken in view. On the other hand, in the case where there were dents, any dents with a depth of below 0.1 mm were of no substantial effect on the image quality. The dents with a width of above 1 mm and with a moderate hollow had no effect on the image quality as far as their depth was below 0.2 mm. These dents become gradually less noticeable because of restitutive elasticity (recovery of elasticity) of the toner carrier 24 and eventually disappear during its use. The time required for the disappearance depends on compression set and hardness. The smaller the compression set is, the sooner the dents disappear. A preferable compression set is below 20%. Although a larger hardness is desirable, a smaller compression set would better serve the purpose than the larger hardness of the toner carrier 24 because the larger hardness causes the driving torque of the developing unit 10 to increase or demands stricter accuracy in machining and installing the devices and components.

For the above reasons, the inventor and his group propose a hardness of 40 degrees (JIS K6301 A-type) of the elastic body layer 31*b*. When the elastic body layer 31*b* is provided with a flexible layer 31*c*, its hardness increases by several degrees; because the part of the hardness meter for pressing the object is arranged in needlelike form and this causes a part of the flexible layer 31*c* and its vicinity pressed by the needle to be hollowed, thereby increasing the load that is to be applied to the needle. The inventor and his group thus concluded from their test results that the hardness of a toner carrier 24 having a flexible layer 31*c* to be below 45 degrees, or preferably 20 to 35 degrees, with a tolerance of ±5 degrees, or more preferably ±3 degrees. As a result, the drive torque of the developing unit is below 1 kg·cm and the machining and installing accuracy of the devices and components is made less restrictive.

Embodiment 5

In this embodiment, a toner carrier 24 of such a construction as shown in FIG. 12 was used, in which the compression set of the elastic body 31*b* that is a roller base was set to below 10% and the surface roughness thereof below 20 μm Rz (JIS B0601) and below 50 μm Rmax (JIS B0601).

The inventor and his group have advocated that the preferable smoothness or roughness of the surface layer of the toner carrier is below 3 μm Rz (JIS B0601) for reasons that the consistency of thickness and quantity of electrification of the toner layer formed on the toner carrier 24 can be maintained and nonuniform density and fog on the developed image can be prevented. In the present embodiment, the adjustment of the surface roughness of the elastic body layer 31*b* inside the surface layer to the above values allowed the surface roughness of the surface layer 31*c* formed on the outside of the elastic body layer to be easily adjusted to below 3 μm Rz (JIS B0601). By adjusting the surface roughness of the elastic body layer 31*b* to below 10 μm Rz (JIS B0601), the surface roughness of the surface layer 31*c* could be adjusted to below 3 μm Rz (JIS B0601) without finishing it after the surface layer had been formed.

If the thickness of the surface layer 31*c* were above 20 μm, the above surface roughness could have been satisfied. However, if dusts or large particles of the surface layer material are present, a finishing operation is needed; and such finishing was simpler than the conventional. Further, by adjusting the surface roughness of the elastic body layer 31*b* to below 20 μm Rz (JIS B0601) and below 50 μm Rmax (JIS B0601), a uniform toner layer was formed on the developing roller and there was no deterioration in image quality with the surface layer 31*c* of 6 μm Rmax (JIS B0601) in surface roughness.

This point will be described with reference to FIG. 14. FIG. 14 is a sectional view schematically showing an example of the elastic body layer 31*b*, which is a roller base, having a surface layer 31*c* on its surface. Part (a) of FIG. 14 shows an elastic body layer 31*b* whose surface is roughened; and part (b) of FIG. 14 an elastic body layer 31*b* whose surface is smooth. In the case of part (a) of FIG. 14, the behavior such as elastic deformation when the elastic body layer is pressed on the surface is different from one portion to another, and there is a tendency that the toner layer is less subject to uniformity. Therefore, the surface roughness of the surface layer in the example of part (a) of FIG. 14 must be smaller than that of part (b) of FIG. 14. If the surface of the elastic body layer 31*b* is highly roughened, to reduce the surface roughness of the surface layer 31*c* is of no help in improving the image quality, nor is it easy to do so.

Since the thickness of the toner layer formed on the toner carrier 24 and adhesiveness of the toner are affected by the surface roughness of the toner carrier 24, there may be some cases in which the surface roughness of the surface layer 31*c* is made higher than that in the present embodiment, and in this case, the surface roughness of the elastic body layer 31*b* that is a roller base is preferably set to below 20 μm Rz (JIS B0601) and below 50 μm Rmax (JIS B0601). The reason is because, as described previously, the behavior of the toner carrier 24 when elastically deformed is different from one place to another, and it is difficult to make the surface roughness of the surface layer 31*c* uniform, and as a result, it is likewise difficult to make the toner layer to be formed on the toner carrier 24 uniform.

A method of forming the surface layer such as discussed above will next be described. A method, in which a surface layer 31*c* of a predetermined thickness is first formed on an elastic body layer 31*b* whose compression set is below 20% and finished by grinding to a thickness around the predetermined value thereafter more than once, is preferable for the reason that the thickness of the surface layer 31*c* required for the toner carrier 24 as its characteristic affects its resistance.

The inventor and his group have advocated that the resistance of the surface layer 31*c* is below $10^7$ Ωcm in specific resistance, and below $1\times10^9$ Ω·cm$^2$, or more preferably $1\times10^7$ Ω·cm$^2$ in surface resistance. If applied to a developing method which allows such a wide range of resistance, the surface layer 31*c* may be formed with a thickness that is greater than a predetermined value using a material whose resistance is below $10^7$ Ωcm. For example, using a material whose resistance is $10^4$ Ωcm, its thickness may be above 30 μm. However, the surface roughness of the elastic body layer 31*b* must be equal to or smaller than 20 μm Rz (JIS B0601). In view of preventing inconsistency in product quality, it is recommended that the thickness of the surface layer be first formed into above 30 μm and then finished so that it is approximately 30 μm. Since this value was obtained only from the viewpoint of resistance, it may be between 50 and 200 μm when such factors as abrasion resistance and accuracy in grinding are taken into consideration. When applied to a developing method in which the range of allowable resistance is narrow; i.e. the resistance of the surface layer 31*c* affects the image quality, the surface layer 31*c* is advantageous in that its layer thickness can be formed uniform by following the above layer forming method. For a more accurate thickness, the layer forming process and finishing process may be repeated.

Further, these processes may likewise be repeated to obtain a thicker layer or a lamination of heterogeneous layers. The finishing process may be repeated after having formed the surface layer 31*c* with a predetermined thickness, or the layer formation process may be repeated before finishing.

It is also recommended that a process of first forming the surface layer 31*c* into a predetermined surface roughness or greater and then finishing it into a predetermined surface roughness or smaller be performed at least once. This is because the surface roughness of the elastic body layer 31*b* has a bearing on its contactness with the surface layer, and in cases where the surface roughness of the elastic body layer 31*b* cannot be made smaller or it is difficult to do so; i.e. the material of the elastic body layer is viscous, the surface is subject to abrasion.

In the case where the elastic body layer 31*b* is made of a foamed body, foamed cells that are present on the surface hinder the surface from being smoothened. In such a case, a coarse surface layer is formed on the elastic body layer 31*b* and it is then finished into a desired surface roughness. Especially, when forming a surface layer on the foamed body, it is preferable that the surface layer forming process should be repeated for several times, and the finishing process may be effected each time such layer forming process is performed. Further, there is a case in which it is difficult to obtain a predetermined surface roughness due to dusts when the surface layer is formed even if the elastic body layer 31*b* has a smaller surface roughness. In this case, it is proposed that the formation of a surface layer precede the finishing process. This may be performed at the same time with the previously described finishing process for the surface layer.

Embodiment 6

This is an embodiment in which a toner carrier 24 of below 10 μm Rz (JIS B0601) in surface roughness after a predetermined abrasion resistance test and below 20% in compression set was used.

A abrasion resistance test will first be described with reference to FIG. 15. FIG. 15 is a perspective view schematically showing a state of abrasion resistance test, in which reference numeral 14 designates a toner carrier (developing roller); 35, sand paper; and 36, a clamping plate. The clamping plate 36 is 4 mm in thickness t and its length along the axis of the toner carrier 24 is greater than the axial length of the toner carrier 24. The toner carrier 24 is constructed so that when a load w is applied, the clamping plate 36 loads uniformly both the interposed sand paper 35 and the toner carrier 24 along the length of the toner carrier 24. It is also arranged so that the toner carrier 24 can be rotated while rubbed with the sand paper 35 under the load w.

The circumferential speed of rotation at the test is supposed to be the same as that to be used as a developing unit 20. The sand paper 35 must be clamped by the clamping plate 36 and bonded so that it will not be dislocated. The sand paper 35 to be used is Tamiya Model Nos. 600 and 180 (manufactured by Komatsubara Grinding and Manufacturing). A load of 100 g/cm is to be applied with No. 600, and a load of 70 g/cm with No. 180.

A first abrasion resistance test involves rotation of the toner carrier 24 for 10 seconds by applying a load of 100 g/cm using a No. 600 sand paper and then measurement of its surface roughness. This test is repeated for another toner carrier 24 with a load of 70 g/cm and a No. 180 sand paper. The circumferential speed of this embodiment was adjusted to about 70 mm/s since that of the toner carrier 24 at development is about 70 mm/s.

The result of the first abrasion resistance test was below 10 μm Rz (JIS B0601) with both sand papers Nos. 600 and 180. This first abrasion resistance test is to ensure the prevention of deterioration in image quality caused by the toner carrier 24 damaged by dirt, dusts and a mass of toner. In other words, as far as the surface roughness of the toner carrier 24 is below 10 μm Rz (JIS B0601) after the first abrasion resistance test, it is ensured that no damaged toner carrier will deteriorate the quality of image.

A second abrasion resistance test involves rotation of the toner carrier 24 for $NT/k_1$ seconds by applying a load of 100 g/cm, using a No. 600 sand paper and then measurement of its surface roughness. This test is repeated for another toner carrier 24 for $NT/k_2$ seconds with a load of 70 g/cm and a No. 180 sand paper. Here, N is the specification expressing the number of printed sheets (life) of a developing unit, and in this embodiment it is set to 100,000 sheets; and T is the average time in second during which the toner carrier 24 is being rotated for printing one sheet, and in this embodiment it is set to 10 seconds; $k_1$ and $k_2$ are the acceleration coefficients, of which $k_1$ is 1000 and $k_2$ is 2000. Therefore, in this embodiment, $NT/k_1$ is set to 16 minutes 36 seconds, while $NT/k_2$ is 8 minutes 18 seconds. The result of the second abrasion resistance test was below 10 μm Rz (JIS B0601) with both Nos. 600 and 180 sand papers.

This second abrasion resistance test is to ensure the prevention of deterioration in image quality caused by the toner carrier 24 worn over a long period of use. In other words, as far as the surface roughness of the toner carrier 24 is below 10 μm Rz (JIS B0601), it is ensured that no worn toner carrier will deteriorate the quality of image. When the inventor and his group conducted a printing test of 100,000 sheets using the above toner carrier, the toner carrier was free from damage or abrasion, thereby keeping the image quality unimpaired.

The first developing unit according to the present invention is not limited to the modes described in the embodiments 4 to 6, but may be applied to a toner carrier having a flexible layer 31*c* on the elastic body layer 31*b*, or one having a plurality of such flexible layers on a plurality of such elastic body layers. Nor is it limited to the contact type developing means; especially, it is applicable to a toner carrier whose surface is a flexible conductor layer 31*c*, a toner carrier further having a resistor layer on its flexible conductor layer, or a toner carrier 24 having a conductive elastic body layer 31*b* as a roller base and having at least a flexible resistor layer on the surface thereof.

Embodiment 7

This embodiment is a developing unit using a toner carrier 24 which satisfies the condition that the resistance is below $1\times10^7$ Ω·cm² when measured after a predetermined abrasion resistance test and that the compression set is below 20%. A first abrasion resistance test in this embodiment is the same as that in embodiment 6.

The result of the first abrasion resistance test was below $1\times10^7$ Ω·cm² with both sand papers Nos. 600 and 180. A toner carrier 24 such as this could prevent the deterioration in image quality due to variations in resistance caused by the damaged toner carrier 24 during use of the developing unit.

A second abrasion resistance test in this embodiment is also the same as that in the previous embodiment. The result was below $1\times10^7$ Ω·cm² with both sand papers Nos. 600 and 180. A toner carrier 24 such as this could prevent the deterioration in image quality due to variations in resistance caused by the worn toner carrier 24 during use of the developing unit. The printing test of 100,000 sheets conducted on this embodiment indicated that the resistance was within the tolerance of below $1\times10^7$ Ω·cm² with no resultant deterioration in image quality. The resistance was measured under a potential difference of 10 V.

The present invention is not limited to the mode of this embodiment, but may be applied to a developing unit having a developing roller in which the resistance on the surface thereof affects the image quality. In this case, the tolerance of resistance varies depending on respective developing units and developing means and should be determined by the effect the resistance exerts on their initial image. This embodiment is also applicable to a toner carrier whose surface is made of a flexible conductor layer 31*c*, a toner carrier further having a resistor layer on the conductor layer, or a toner carrier having a conductive elastic body layer 31*b* as a roller base and having at least a flexible resistor layer on the surface thereof.

Embodiment 8

This embodiment is a case where a toner carrier 24, in which both an elastic body layer 31*b* (developing roller base) having a compression set of below 10% and a flexible surface layer 31*c* are formed integrally with each other while satisfying a peel strength of above 20 g/mm, was used. A method of measuring the peel strength will first be described with reference to FIG. 16. FIG. 16 is a schematic showing the method of measuring the peel strength, in which reference numeral 24 designates a toner carrier; 31*b*, an elastic body layer which is a roller base; 31*c*, a flexible surface layer, a part of which is peeled. The toner carrier 24 is rotatably supported by a shaft 31*a*. The surface layer 31*c* is peeled as wide as W and in a direction of causing the surface layer to be peeled as the toner carrier 24 is rotated. In this case, a portion whose width is W is cut on the surface layer 31*c* (as shown in the figure) to thereby reduce the influence on other parts. If it is not easy to peel the surface layer 31*c*, a white gummed cloth tape, or SULION TAPE® (manufactured by Kanbara Kogyo) is bonded to a part to be peeled and is peeled together with that part of the surface layer 31*c*. If the surface layer 31*c* is strongly adhesive, ARONALPHA® (manufactured by Toa Synthetic Chemical) is applied to a formed between the surface layer 31*c* and the SULION TAPE and is bonded to peel a part of the surface layer. The SULION TAPE is effective in peeling a part whose peel strength is below 20 g/mm, and therefore, it serves as a criterion in judging the peel strength. If a tape is used, it is preferable that bonding of the tape should precede cutting.

Since the toner carrier 24 is supported rotatably, the surface layer 31*c* is peeled substantially in a tangential direction of the toner carrier 24 with a width of W (mm). A force F (g) to be applied to peel the surface layer is provided by stretching the part of the surface layer at right angle to the shaft in the tangential direction of the toner carrier 24. The speed of peeling should be about 1 mm/sec. In this embodiment, the width W was adjusted to 10 mm. Using a load converter, the force F was recorded by a recorder in function of time for stretching the surface layer under a normal temperature and moisture, preferably 20° C. and 50%RH. Since the peeling speed is known, the relationship between the peeled length and position and the force can be found easily. The peeling strength (g/mm) is a peeling force per length F/W (g/mm) obtained from both the force F (g) and the width W (mm) thus found. In view of the fact that the force F recorded on the recorder is generally wavy and that, among the points measured while the toner carrier 24 made one full rotation, a part of the surface layer was, in some cases, not peeled or the force F was significantly different from other parts, a total of 10 points including the smallest 5 points and the greatest 5 points, both the start and end points exclusive, were used. Likewise, other values were taken in several points by peeling another part of the surface layer and averaged to obtain an average value. When a point in one full rotation of the toner carrier 24 at which the force F is small is close to a point in one full rotation made at another place on the toner carrier, the force F, not an average value out of the values measured at 10 points, was used. If there was a difference along the length, the average value of the force F at a point where it was the smallest in one full rotation of the toner carrier 24 was used. In this embodiment, the peel strength was above 20 g/mm. It is preferably above 40 g/mm, or a surface layer which cannot be peeled is ideal.

A toner carrier 24 such as used in this embodiment could provide a developing unit capable of producing developed images that suffered no deterioration in image quality due to the surface layer being peeled during use over a long period of time. The surface layer 31*c* formation method described in embodiment 5 is applicable to this embodiment. This embodiment is also applicable to a toner carrier whose surface is made of a flexible conductor layer 31*c*, a toner carrier further having a resistor layer on the conductor layer, or a toner carrier having a conductive elastic body layer 31*b* as a roller base and having at least a flexible resistor layer on the surface thereof.

Embodiment 9

This embodiment is a case where a toner carrier 24 of below 20% in compression set, whose surface resistor layer 31*c* is made of a material containing at least urethane, fluorine-contained resin or silicone and whose elastic body layer 31*b* serving as a roller base is made of a material containing at least urethane, ethylene-propylene rubber (EPR or EPDM), NBR rubber or silicone, was used.

This toner carrier is applicable to any of embodiments 4 to 8 and embodiment 10 (described later). The most preferable arrangement is to have the surface resistor layer 31*c* made of a urethane elastomer, and the elastic body layer 31*b* made of urethane, EPDM or NBR rubber. If the peel strength of the urethane elastomer of the surface resistor layer 31*c* with respect to the elastic body layer 31*b* is not sufficient, it is recommended that the elastic body layer 31*b* be subjected to a surface treatment with a primer. A combination of fluorine-contained surface resistor layer 31*c* with a silicone elastic body layer 31*b* is also preferable. In this case, a surface treatment of the elastic body layer 31*b* with a primer would be recommended.

A combination of silicone surface resistor layer 31*c* with a silicone or urethane elastic body layer 31*b*, and the same combination with an additional arrangement of a fluorine-contained resistor layer on the silicone surface resistor layer 31*c* are all recommendable. The adequate peel strength was ensured with these combinations. Each of their peel strengths was above 40 g/mm.

The surface resistor layer 31*c* is selected by the polarity of triboelectrification. In order to have a positively charged surface, urethane or silicone is preferably used, while in order to have a negatively charged surface, a fluorine-contained material is used. The resistance of each layer is adjusted by mixing conductive carbon, metal powder or metal fiber. As to the surface layer, those characteristics which were discussed in embodiments 4 to 8 and which will be discussed in embodiment 10 must be taken into account particularly for the adjustment of its thickness which is among its critical issues.

The inventor and his group used: SPAREX DH-20Z313 of Nippon Miractran as a surface layer 31*c*: a primer or ELECTROPACK Z-279 (manufactured by Daitai Chemical Industries), and AE-85® (manufactured by Nippon Polyurethane) as a urethane elastomer; and teflon® or latex® as a fluorine-contained material. They used: an EPDM rubber roller fabricated by Daiwa Rubber, a urethane rubber roller by Bando Chemical Industries., an NRB rubber roller by Nippon Zeon (machined by Minami Chemical Laboratory), an LL rubber (urethane-based rubber sponge) by Bridgestone, a RUBICEL (urethane-based sponge) by Tokyo Polymer, a silicone roller by Toshiba Silicone (machined by Showa Electric Wire and Cable), ENDUR (urethane sponge) by Inoue MTP as an elastic body layer 13*b* and the like. The elastic body layer 31*b* whose resistance can be adjusted to a lower value (below $10^8$ $\Omega\cdot cm^2$) includes: the EPDM rubber roller of Daiwa Rubber; the urethane rubber roller by Bando Chemical Industries; the RUBICEL by Toyo Polymer; silicone by Toshiba Silicone; and silicone by Tore Silicone.

Embodiment 10

This embodiment is a case where a toner carrier 24 whose friction coefficient is below 0.6 when measured by a predetermined method and whose compression set is below 20%. A method of measuring the friction coefficient will first be described with reference to FIG. 17.

FIG. 17 is a perspective view schematically showing the method of measuring the friction coefficient. A sheet 37 specified for Toshiba PPC is stuck on a clamping plate 36 by an adhesive double coated tape. The specified sheet 37 is interposed between the clamping plate 36 and the toner carrier 24 so that a uniform load w can be applied to the toner carrier 24. The thickness t of the clamping plate 36 is 10 mm and its length along the axis of the toner carrier 24 is greater than the length of the toner carrier 24. The toner carrier 24 is arranged so that it is rotatable while rubbed with the specified paper 37 under the load w. Measurements are made under a normal temperature and humidity, or preferably 20° C. and 50% and with a load w applied. A maximum startup torque required for rotating the toner carrier 24 that is stationary is measured, and a maximum force tangential to the part that is in contact with the specified sheet 37 is calculated. A maximum stationary friction coefficient between the specified sheet 37 and the toner carrier 24 can be obtained by dividing this force by the total load (load w to which the weight of the clamping plate is added where necessary) applied to the part that is in contact with the specified sheet 37.

In this embodiment, this value is adjusted to below 0.6. In this embodiment, the drive torque of the toner carrier 24 in the developing unit can be made small, whereby the drive motor can be made smaller in structure and more inexpensive. This embodiment achieved a reduced torque of below 1 kg cm including all the drive torques of the drive components in the developing unit such as the toner carrier 24 and the toner supplying roller 24*a*. The friction coefficient is preferably below 0.5.

As described above, the first developing unit according to the present invention provides an inexpensive developing unit capable of producing high quality images even after a long period of use or nonuse.

Embodiment 11

A second developing unit, which is another embodiment of the present invention, will next be described.

A basic arrangement of the developing unit is the same as that shown in FIG. 11. A toner carrier 24 in the present embodiment, however, has a flexible conductive layer 31*c* arranged on the surface thereof and an elastic body layer 31*b* inside. The resistance of the surface conductive layer 31*c* is below $1\times10^9\ \Omega\cdot cm^2$, while the hardness of the toner carrier 24 is below 40 degrees (JIS K6301 type A) and its compression set below 20% (JIS K6301). A urethane foam-made toner supplying roller 24*a* was used. A plate made of a silicone rubber which is susceptible to triboelectrification as a toner layer thickness regulating member 24*b* serving to regulate the toner layer that adheres to the toner carrier 24 and give triboelectric charges to toner particles through triboelectrification. Among various dimensions and pressing techniques of the toner layer thickness regulating member 24*b* (coating blade) such as pressing the middle part of a flat plate or pressing the edge of a flat plate, this embodiment involves a flat plate whose end part is formed into a circular arc of 3 mm in diameter and a technique of pressing this circular arc part.

In a developing unit using such an elastic toner carrier 24, the compression set of the toner carrier 24 deteriorates the image quality. Parts subject to compression set include those subjected to pressure by the toner layer thickness regulating member 24*b*, those subjected to pressure by the electrostatic latent image holding body (photosensitive drum) 26, those in contact with the toner supplying roller 24*a*, and those in contact with the recovery blade 24*c*. Compression set caused in those parts which are in contact with the toner supplying roller 24*a* and the recovery blade 24*c* accounts almost none for deforming the toner carrier 24.

Since the part pressed by the electrostatic latent image holding body 26 was actually deformed below 0.1 mm, the use of a toner carrier 24 whose compression set was below 20% not only caused dents, i.e. distortions, of only below 0.02 mm but also allowed the manner of indentation to be moderate. As a result, the image quality suffered few deterioration. Thus, the maximum allowable distortion at this part was below 0.05 mm. On the other hand, since the part pressed by the toner layer thickness regulating member 24*b* received a large pressing force in a narrow pressing area, once the toner carrier was placed in poor environments of storage and use, the image quality was, in some cases, deteriorated. It goes without saying that moderate environmental conditions will be desirable.

Figure 18:
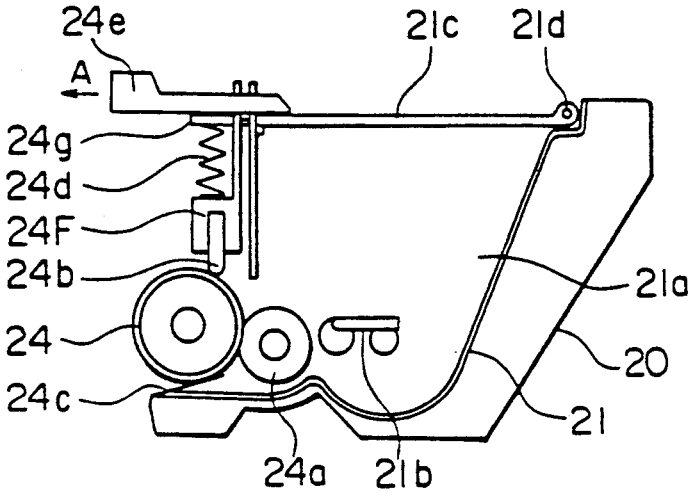

FIG. 18 is a sectional view showing the arrangement of the main portion of a developing unit according to the present invention. The developing unit is based on the electrophotographic unit whose arrangement is as described before referring to FIG. 11. Like reference numerals designate like parts and components in FIG. 11.

In this embodiment, it is arranged so that the pressing force between the toner carrier 24 and the toner layer thickness regulating member 24*b* can be reduced. That is, a stopper 24*e* is inserted to a holder 24*f* of the toner layer thickness regulating member 24*b* to lift the toner layer thickness regulating member 24*b* in a direction of separating it from the toner carrier 24. In using a developing unit having such means for reducing the pressing force of the toner layer thickness regulating member 24*b* (stopper 24*e*) specially arranged, the extraction of the stopper 24*e* in the direction indicated by the arrow A will put such a developing unit under the same condition as in the developing unit shown in FIG. 11. Before the developing unit is put in operation, the toner 21*a* must be supplied to the toner container 21. Since it is so arranged that the cover 21*c* of the toner container 21 shown in FIG. 18 is not allowed to be opened unless the stopper 24*e* is removed, this arrangement contributes to confirming that the stopper 24*e* has been properly extracted before starting the developing unit.

The cover 21*c* is pivotable around a pivot 21*d* so that it can be opened to receive the toner. A known toner cartridge will also serve to remind the use to extract the stopper 24*e*. The end part of the stopper 24*e* is wedge-like as shown in the figure to thereby facilitate its insertion into the toner layer thickness regulating member 24*b* holder 24*f*. A lifting amount of the toner layer thickness regulating member 24*b* in order to produce a few deteriorated image is, according to the tests conducted by the inventor and his group, such as to adjust the product of a deformation of the toner carrier 24 caused by the toner layer thickness regulating member 24*b* and a compression set of the toner carrier 24 to below 0.02 mm.

Since the deformation and compression set of the toner carrier 24 without the stopper 24*e* was 0.2 mm and below 20%, respectively, a lifting amount of 0.1 mm of the stopper 24*e* caused a deformation of 0.1 mm with the stopper 24*e* inserted to thereby make the product of the deformation and the compression set to be 0.02 mm. It was further found that the installation of the stopper 24*e* contributed to reducing the actual distortion compared to the calculated distortion of 0.02 mm. This is because any change in the environment without stopper 24*e* caused the elasticity of the toner carrier 24 to vary to thereby increase the deformation thereof.

The rubber material to be used as the toner carrier 24 is not a genuinely elastic body, but a so-called viscoelastic body, and it takes time for the viscoelastic body to set the deformation after the application of a load. Therefore, the deformation may, in some cases, be increased with increasing time during which the load is applied. This means, however, that the deformation of a viscoelastic body that is time-dependent may be recoverable depending on the environment in which the viscoelastic body is placed. Thus, an acceptable image quality could be attained without separating the toner carrier 24 from the toner layer thickness regulating member 24*b*. For example, the developing unit can still produce a satisfactory image after being left unused for a long period of time even with the stopper 24*e* inserted back into position with the toner contained in the toner container. This is thus advantageously applicable to high-quality color image production with a developing unit containing color toner particles.

Means for reducing the pressing force of the toner layer thickness regulating member 24b is not limited to the above embodiment but may be arranged so as to move a spring supporting member 24g for supporting the spring 24d or directly move the toner layer thickness regulating member 24 itself. The reason why the holder 24f is moved in this embodiment is because its greater friction with the stopper 24e hinders insertion of the stopper 24e. Since, in this embodiment, the toner layer thickness regulating member 24b is made of a silicone rubber whose friction coefficient is large, the system of moving the holder 24f was adopted. The stopper 24e should be extracted in directions other than towards the toner container 21 not only from the viewpoints of operation and design but also because a known toner cartridge, if used, will occupy the space over the toner container 21, thereby interfering with the stopper 24e.

As described in the foregoing, the arrangement or means for reducing the pressing force of the toner layer thickness regulating member 24b is not limited to the above embodiment, and its drive mechanism may be either manual or automatic. For example, the drive force inherent in the electrophotographic device may be used in combination of cams, links and gears. An electromagnetic force may be employed for insertion and extraction of the stopper 24e. To operate it automatically, it is desirable that the stopper 24e and the mechanism for transmitting the drive force to the stopper 24e should be releasable. It is preferably required to equip a stopper 24e with holes or hooks in the end parts thereof, or with ]-shaped gears.

Figure 19:
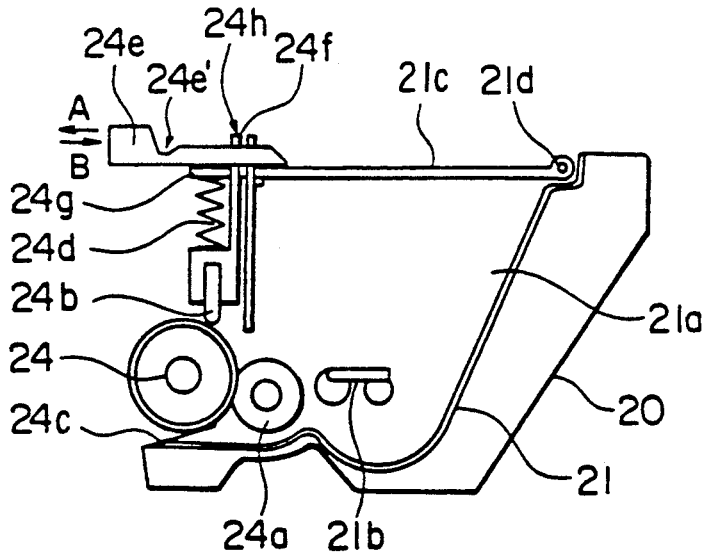

FIG. 19 shows an example in which some functions are added to the stopper 24e of such an arrangement shown in FIG. 18. In this case, the pressing force of the toner layer thickness regulating member 24b can be reduced before the developing unit is put in operation and can be increased to an appropriate value when it is put in operation. That is, when inserted in the direction B, the stopper 24e is located at the position of the holder 24f to thereby cause the holder 24f to receive the load adjusted by the spring 24d. The part of the stopper that extends over to the toner container 21 should be so formed as not to play very much.

In FIG. 19, a positioning member 24h helps appropriately position the stopper 24e at the left side surface of the stopper location 24e'. The right side surface of the stopper location 24e' is formed so as to allow the stopper 24e to be extracted smoothly. The stopper 24e serves also as a stopper for the cover 21c, thereby serving to hold a member for forming the cover 21c (known cartridge) during use.

Figure 20:
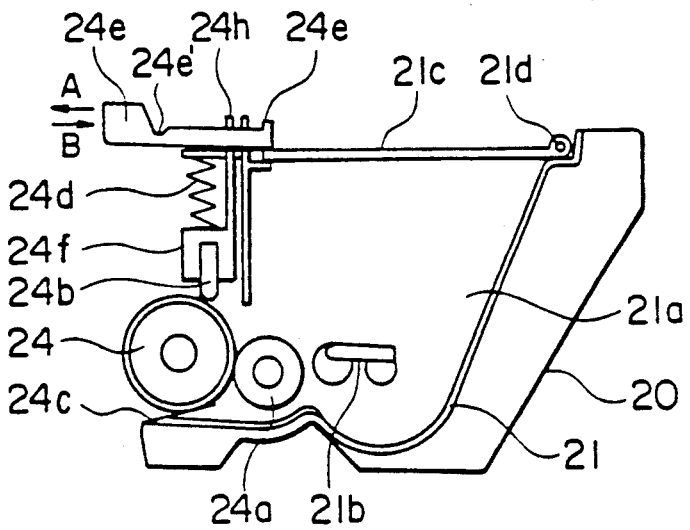

FIG. 20 is an example of an arrangement in which a member for reducing the pressing force is unreleasable from the developing unit. As shown in the figure, the stopper 24e is provided with a projection 24e'' for stopping the holder 24f end part of the toner layer thickness regulating member 24b, and is pulled in the direction A to supply the toner and pushed in the direction B when not used. Before use or during nonuse, the stopper 24e is located at the position shown in the figure.

Figure 21:
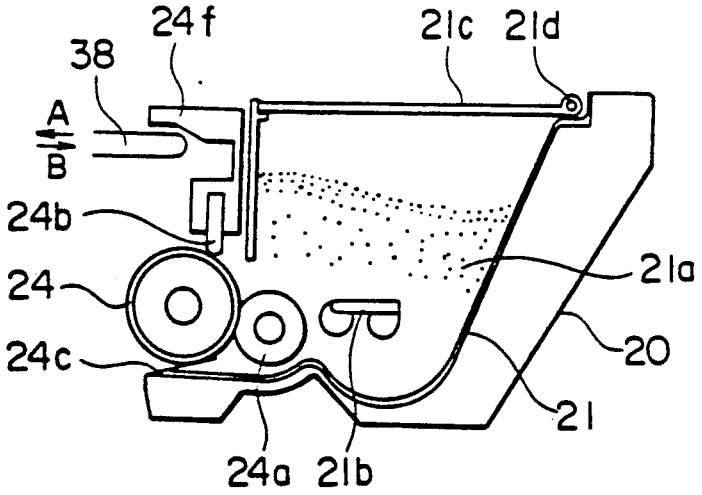

FIG. 21 shows an example in which the pressing force is reduced by controlling the profile of the holder 24f, i.e. without passing the stopper 24e through other members. A member 38 which moves forward and backward in the directions A and B facilitates the attaching and releasing movement between the toner layer thickness regulating member 24b and the toner carrier 24 with a spring force of the holder 24f. Thus, this arrangement is suitable for automatically reducing the pressing force.

As described above, in the second developing unit, the pressing force of the toner layer thickness regulating member 24b for pressing the surface of the toner carrier 24 that has an elastic body is reduced during use or nonuse. As a result, it is possible to effectively prevent the image quality from being deteriorated by the compression set of the toner carrier. It is also advantageous in that this arrangement demands less restrictive environmental conditions under which the developing unit is installed or warehoused. Furthermore, the additional means are simple and inexpensive.

Embodiment 12

A third developing unit which is still another embodiment of the present invention will next be described.

Basic operations of the developing unit according to the present embodiment are as listed below. In a first case, the toner layer thickness regulating member, as it is made of a soft platelike high polymer, is subject to deformation in such a flexible manner that slight machining inaccuracies, if any, of either itself or of the toner carrier can be offset, and thus a toner layer of uniform thickness can be formed with a relatively small pressing force. Being elastic, platelike and pressed at the end part thereof, the toner layer thickness regulating member undergoes a flexible deformation.

This toner layer thickness regulating member is of such type that the end part thereof is pressed, thereby regulating the toner layer thickness with a smaller pressing force than such other type that the middle part is pressed. This, then, requires only a small force for driving the toner carrier and prevents the toner from adhering to the toner layer thickness regulating member when used for a long time.

Furthermore, since there is no such concentration of pressure on a small area as in the case of pressing a sharp end part, slight variations in conditions such as pressure and installation does not affect the state of the toner layer. For the same reason, machining accuracy requirements are also comparatively moderate. In the method of pressing a flat end part, although it sometimes happens that a slightest variation in the conditions causes nonuniformity of the toner layer thickness due to the edge of the flat end part contacting the toner carrier, there is no such problem at all with the present invention.

If the toner layer thickness regulating member is made of a combination of a soft platelike high polymer and a rigid supporting member that is inserted into the high polymer, its abundant deformability contributes to compensating for a nonuniform toner layer. Since both the rigid supporting member and the elastic high polymer can be integrally molded by, e.g. insert molding, a subsequent process of bonding both members together can be dispensed with, thereby allowing the overall manufacturing and assembling processes to be simplified.

In a second example, in addition to the toner layer thickness regulating member, a flexible platelike toner supplying member is further arranged adjacent to the toner carrier. This arrangement is advantageous in maintaining the toner layer of a certain thickness at any given time with a prompt supply of toner on the surface of the toner carrier even if the toner is consumed in large quantities by development. Compared to a prior art method of supplying the toner to the toner carrier by rubbing the toner carrier with a toner supplying roller such as a sponge roller, the present invention allows a supply of toner without driving the toner supplying member, thereby advantageously reducing the size and cost of the developing unit.

The principle of supplying the toner by the platelike toner supplying member is partially in common with that of forming a toner layer by the platelike toner layer thickness regulating member. The arrangement of the platelike toner supplying member adjacent to the toner carrier is no other than forming a space analogous to the wedge formed between the middle part of the platelike toner layer thickness regulating member and the toner carrier. An aggregate of toner that entered and remained in this space as the toner carrier moved was strongly pressed on the surface of the toner carrier by the pushing force derived from a successively incoming aggregate of toner so that it can adhere to the surface of the toner carrier.

Since the toner is promptly supplied to the surface of the toner carrier in this way, there is no likelihood that the developing density will be reduced even after large quantities of toner have been consumed by developing an entirely solid black image. Hence, a satisfactory uniform density image can be maintained. Especially, in regulating the toner layer thickness at the end part of the platelike member as in the first case, a regulation better than by the technique of pressing the middle part can be obtained; however, the wedgelike space is not always so properly formed that a supply of toner at the position of the toner layer thickness regulating member generally tends to be inadequate. The use of the platelike toner supplying member in such a case ensures the proper supply of toner, thereby providing an additional advantage of only having to take care of ensuring the proper regulation of the toner layer thickness at the position of the toner layer thickness regulating member.

When the toner supplying roller and the platelike toner supplying member is used simultaneously, the toner will be supplied in far better manner, thereby providing another big advantage in developing the image satisfactorily.

Specific examples will be described with reference to the accompanying drawings.

The third developing unit according to the present invention has an arrangement basically similar to that shown in FIG. 10. The third developing unit comprises: a toner container 11 for containing a single component toner 11*a*; a toner supplying roller 14*a* for supplying the single component toner 11*a* to a toner carrier (developing roller) 14; a toner layer thickness regulating member 14*b* for forming a uniform toner layer on the toner carrier 14 by regulating the supplied toner; an electrostatic latent image holding body (photosensitive drum) 16 which confronts with the toner carrier 14 that rotates while supporting the toner layer and which renders an electrostatic latent image formed and supported on the surface thereof visible; a recovery blade 14*c* for recovering the toner remained after development into the toner container 11; a stirring member 11*b* for stirring the toner 11*a* within the toner container 11; a spring 14*d* for pressing the toner layer thickness regulating member 14*b* on the toner carrier 14 with a predetermined load; a charger 15 for giving a predetermined quantity of electrostatic charges to the photosensitive drum serving as the electrostatic latent image holding member 16; exposing means 17 for forming a predetermined electrostatic latent image on the surface of the electrostatic latent image holding body 16; a transfer unit 18 for transferring an image made visible by developing the electrostatic latent image on the surface of the electrostatic latent image holding body 16 to a supporting body such as paper; a dc power supply 12 for supplying a predetermined current to the toner carrier 14 and the toner supplying roller 14*a* through a protective resistor 13 and the like.

There are several methods of developing an electrostatic latent image: by scattering toner particles by means of a developing electric field while putting the surface of a latent image out of contact with that of the toner carrier 14; by pivoting or sliding the toner carrier while bringing both members into contact; or by forming either a dc or ac electric field between the two members. Although any of the above methods are applicable, a developing method in which both the surface of the latent image and that of the toner carrier are abutted against each other will be described in this embodiment.

The toner layer thickness regulating member 14*b* is made of a platelike rubber high polymer of 30 to 100 degrees in hardness whose end part is formed into a cylindrical surface or curving surface (cylindrical surface to curving surface). Its tip is abutted against the surface of the toner carrier 14 by a pressing force of the spring 14*d*. Making the profile of the tip of the toner layer thickness regulating member 14*b* circular arc or curve provides, as previously described, the effect that is intermediate between the effect of pressing the middle part and that of pressing the sharp edge, thereby not only allowing a thin layer of toner to be formed as desired with a relatively small pressing force but also properly triboelectrify the toner particles. The radius of curvature of the cylindrical surface or the curving surface on the tip is 0.1 to 20 mm, or preferably 0.5 to 10 mm, will provide a satisfactory result. If it is smaller than 0.1 mm, the shortcomings associated with the pressing of the sharp edge were exhibited to some extent, while if it is more than 20 mm, the problems associated with the pressing of the middle part were likewise presented.

The surface roughness is relevant to the uniformity of the toner layer. The examination of the relationship between the surface roughness and the image consistency on the basis of the Japanese Industrial Standards B0601, Rz (10-point average roughness) and Rmax (maximum height), indicated that an acceptable toner layer substantially free from thickness nonuniformity was obtained when the surface roughness of the part of the cylindrical surface or end surface of the tip of the toner layer thickness regulating member which was abutted against the toner carrier 14 was at least below 10 μm Rz and below 30 μm Rmax; more preferably, below 5 μm in Rz and below 10 μm in Rmax. Over 10 μm Rz and 30 μm Rmax, the toner layer suffered from a distinct thickness nonuniformity, which led to density nonuniformity in the form of stripes on the image.

Flexibility of the toner layer thickness regulating member 14*b* has a great bearing upon the formation of a uniform toner layer. It was difficult to form a uniform toner layer with a rubber whose hardness is in excess of 100 degrees when measured by a type A rubber hardness meter specified in JIS 6301. It is because there is an upper limit in the accuracy in machining the toner carrier 14 and the toner layer thickness regulating member 14*b*, and thus, in order to make up for these unavoidable inaccuracies, it is required that the toner carrier 14 with a strong pressure. On the other hand, a hardness of the toner layer thickness regulating member 14*b* being less than 30 degrees causes it to either contact the toner carrier 14 or its tip to be turned over or deformed by a pressure coming from the aggregate of toner, thereby making it more likely to form a nonuniform toner layer. A hardness range of 30 to 100 degrees, preferably 50 to 85 degrees, can maintain a toner layer of uniform thickness taking advantage of the toner layer thickness regulating member 14*b* undergoing an appropriate deformation. There exist such optimal values in the thickness of the toner layer thickness regulating member 14*b* and its free length as an elastic plate as to overcome the problems of deformation and the like. The preferred thickness is between 0.5 and 15 mm, while the free length, or the distance between the end part of the supporting body of the toner layer thickness regulating member 14*b* and its free end, is preferably longer than the thickness. A thickness of less than 0.5 mm does not allow an accurate molding of the plate, while a thickness of more than 15 mm increases its unit size because it is necessary to have a long free length in order to obtain an adequate flexibility required as a toner layer thickness regulating member.

Figures 22, 23, 24, 25:
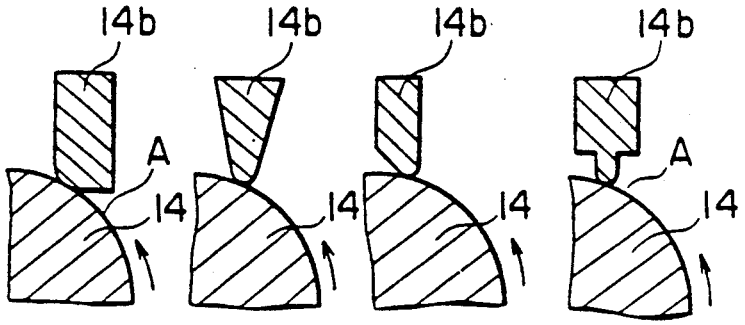

Although in FIG. 10, the tip of the toner layer thickness regulating member 14*b* is formed into a cylindrical surface, other profiles such as sectionally shown in FIGS. 22 to 25 may be conceivable. The profiles of FIGS. 22 and 25 provide a space A which can contain a fairly large quantity of toner between the upstream side on the surface of the toner carrier 14 and the toner layer thickness regulating member 14*b*, thus providing the advantage of promptly supplying the toner when the toner has been consumed in large quantities, which is an advantage similar to that provided when the middle part of the toner layer thickness regulating member 14*b* is pressed. The profiles of FIGS. 23 and 24 make the space A smaller, thereby allowing a thin layer of toner to be formed as desired with a relatively smaller pressing force.

These profiles contribute to further providing the advantage of eliminating foreign matters and mass of toner that are infiltrating under pressure, thereby allowing a uniform thin layer of toner to be consistently formed. The position of the toner layer thickness regulating member 14*b* abutting against the toner carrier 14 can be selectively determined as sectionally shown in FIG. 26. Usually the tip of the toner layer thickness regulating member 14*b* is arranged so as to head toward the central axis of the toner carrier 14 as shown by 14*b*1 in FIG. 26. Its arrangement at 14*b*2, i.e., upstream of the toner carrier 14 contributes to further eliminating the foreign matters, while at 14*b*3, i.e., downstream of the toner carrier 14 serves to improve the toner supply function.

In the case where the toner layer thickness regulating member 14*b* is so constructed as to be moved vertically by a guide member and pressed by the spring 14*d*, it is recommended that the toner layer thickness regulating member 14*b* be arranged at a position 14*b*2 in which both the direction of applying the stress by the toner carrier 14 and the direction of movement of the toner layer thickness regulating member 14*b* almost coincide with each other. Even if the positions 14*b*1 and 14*b*3 are selected, the same advantage as is arranged at the position 14*b*2 in FIG. 26 can be obtained not only by providing the toner layer thickness regulating member 14*b* with a supporting body 39*a* which is movably supported by a guide 39*b* in a direction different from that of the toner layer thickness regulating member 14*b* but also by pressing the toner layer thickness regulating member 14*b* on the toner carrier 14 as shown sectionally in FIG. 27.

As sectionally shown in FIG. 28, the effect to be obtained also varies depending on the direction of abutment of the toner layer thickness regulating member 14*b*, forward or backward with respect to the direction of rotation of the toner carrier 14. The abutment in a forward direction as shown by part (a) of FIG. 28 results in satisfactory toner supply function, while the abutment in a backward direction as shown by part (b) of FIG. 28 contributes to eliminating foreign matters.

There are two methods of fabricating the toner layer thickness regulating member 14*b*: either by forming the tip into a curving surface by cutting, or by molding. Cutting produces a highly accurate curving surface. On the other hand, molding is suitable for mass-production and practicable. In order to produce a toner layer thickness regulating member 14*b* of such a form as shown in FIG. 10 by molding, molds 40*a* and 40*b* such as sectionally shown in part (a) of FIG. 29 are usually used. In this case, in order to prevent presence of burr over the tip surface of the toner layer thickness regulating member 14*b*, the mold must be divided into two portions at a position near the flat portion of the lateral side or rising portion of the curving surface (position 40*c* in part (a) of FIG. 29). As a result, the curving surface of the tip is surrounded by a first portion 40*a* of the mold, and this tends to cause blowholes to deposit there during the molding and thus often forming a defective curving surface.

Dividing of a mold at a flat portion or curving portion, in general, results in generating burr there, hence requiring a complicated deburring operation in the subsequent process. In contrast thereto, if the tip of the toner layer thickness regulating member 14*b* is formed in a combination of curving surface and sharp edge as shown in FIG. 22 or FIG. 24 so that the curving surface is pressed on the toner carrier 14, its mold can be divided such as shown sectionally in part (b) of FIG. 29. The molds 41*a* and 41*b* thus formed may not only reduce blowholes at the curving portion but also requires no deburring operation after molding because of its effect of "biting the burr off". These molds contributed to significantly reducing both defects and costs in the process of mass-production.

In the developing unit of this embodiment, the toner layer thickness regulating member 14*b* which is as low as 30 to 100 degrees in hardness is uniformly pressed on the toner carrier 14 and thus it is preferably supported by a rigid body accurately. In order to uniformly distribute the pressing force along the length of the toner layer thickness regulating member 14*b*, it is not appropriate to press the elastic toner layer thickness regulating member 14*b* directly with the spring 14*d* as shown sectionally by part (a) of FIG. 30. Rather, it is desirable that the toner layer thickness regulating member 14*b* be supported by a rigid supporting member 42 as shown sectionally by parts (b) and (c) of FIG. 30. However, the supporting member 42 may not necessarily be made of a rigid body, but may be made of a hard elastic body such as a phosphor bronze plate or stainless steel plate of above 0.1 mm in thickness, and supports the toner layer thickness regulating member 14*b* as shown sectionally by part (d) of FIG. 30.

After molded, the toner layer thickness regulating member 14*b* must be subjected to a process of either bonding (parts (b) and (d)) or inserting (part (c)) into the supporting member 42 or the elastic plate 43 in these examples. In case of bonding the toner thickness regulating member, firm adhesiveness is required and therefore this limits the choice of component materials and adhesives. In case of inserting the toner layer regulating member into the ]-shaped rigid supporting member 42 as shown by part (c), the rigid supporting body must be provided with a groove whose opening is slightly smaller than the thickness of the toner layer thickness regulating member to firmly hold the toner layer thickness regulating member. The toner layer thickness regulating member 14*b* was deformed while the supporting body was inserted thereto, and this deformation was, in some cases, responsible for the nonuniform toner layer thickness.

On the other hand, as perspectively shown in FIG. 31, a so-called insert molding, in which a supporting member 42 is inserted at the time of molding the toner layer thickness regulating member, may overcome all the aforesaid problems. The supporting member 42 is preferably made of a metal plate of 0.1 to 3 mm in thickness. The length between the tip of the supporting member 42 and that of the toner layer thickness regulating member 14*b*, or free length of the toner layer thickness regulating member, is 1 to 10 mm, or more preferably a value equal to or greater than the thickness t of the toner layer thickness regulating member 14*b* to make the most of its elasticity and form the toner layer more uniformly.

In addition to serving to regulate the toner layer thickness, the toner layer thickness regulating member must serve to triboelectrify toner particles into a predetermined polarity. Thus, its material must be selected in the well-known triboelectric series so that it is charged in a polarity opposite to that of the charged toner particles. In order to charge the toner particles negatively, such a material as silicone rubber, formalin resin, PMMA, polyamide, melamine resin, polyurethane rubber, polyurethane sponge or the like is used. In order to charge them positively, such a material as fluorine-contained resin, polyethylene, acrylonitrile, natural rubber, epoxy resin, nitrile rubber, or the like is preferably used. It is also possible to give an opposite polarity if dyestuff or the like is mixed into any of the above materials.

The material of the toner layer thickness regulating member 14*b* must meet the requirement that the toner particles are not fixed on the toner layer thickness regulating member during its use over a long period of time. Once the toner is fixed, it not only hampers a uniform toner layer from being formed but also causes the toner to be charged inadequately.

It was a material which was composed mainly of either silicone rubber or urethane rubber that worked best among the above-described material, according to the detailed tests conducted by the inventor and his group. Particularly, the silicone rubber, because of its releasability, accepted no fixation of toner particles during its use over an extremely long period of time (a printing cycle of 100,000 sheets). It is preferable, however, that the silicone rubber should contain no or very few migrational plasticizer, vulcanizing agent or antioxidant. It is important to select such a material as not to contaminate the toner material, the toner carrier 14, the photosensitive body serving as an electrostatic latent image holding body 16 and the like through deposition of inclusions called bleed or bloom.

Before using the silicone rubber, its abrasion resistance must be checked. Generally, the silicone rubber has a poorer abrasion resistance than other rubber materials, so that one with a filler added to improve the resistance should be used. The test results conducted by the inventor and his group indicated that any increase in contact area between the regulating member and the developing roller that was more than five times the initial contact area adversely affected the toner layer condition, particularly, the toner layer thickness.

The problem to be noted when molding and machining the elastic toner layer thickness regulating member 14*b* is a "shrinkage cavity". The "shrinkage cavity" herein means that the length l shown in FIG. 31 is different between at both ends in the longitudinal direction and at the middle. After molding a silicone rubber-made toner layer thickness regulating member whose dimensions are: $l=10$ mm, $t=3$ mm, tip radius $=1.5$ mm, and length $=200$ mm, its machining accuracy was checked. The "shrinkage cavity" was present in the area 15 mm from both ends in the longitudinal direction, giving $10<l\leqq 11$ mm. The "shrinkage cavity" is caused when a molding is extracted from the mold, and it is difficult to completely eliminated this. The method of first molding the toner layer thickness regulating member of 250 mm in length and then having it cut 25 mm each from both ends after being extracted from the mold was successful in obtaining a highly acceptable accuracy. The process of cutting improved the previous accuracy of $9.95\leqq l\leqq 10.90$ to $9.95\leqq l\leqq 10.05$. It is recommended that the cutting length with both ends combined be above 5% of the total length.

The toner layer thickness regulating member so constructed as described above allows a toner thin layer which maintains its uniformity over a very long period of time to be formed on the toner carrier 14 surface.

Although this toner layer thickness regulating member 14*b* generally provides high-definition images through its features of longstanding uniform toner layer thickness, there is another thing to be noted. The requirement of quickly supplying the toner 11*a* and readily forming a predetermined thickness of toner layer when the toner is consumed in large quantities by, e.g., developing an entirely solid image. This is the problem one always have to face with a development system that is based on the thin layer of toner. It becomes more crucial for a system using a single component nonmagnetic toner 11*a* because it is in no way possible to supply the toner by electromagnetism.

As shown in FIG. 10, a method of improving the toner transferability of the toner carrier 14 by rubbing the sponge-or rubber-made elastic toner supplying roller 14*a* with the toner carrier 14 is known. A method of using a conductive toner supplying roller 14*a* and applying a voltage thereto to thereby supply toner in the generated electric field is likewise known. However, the latter method has the following drawbacks. Its toner transferability is not always adequate. It requires a large drive force because of the difference in surface speed between the toner carrier 14 and the toner supplying roller 14*a*. It is not available for overall reduction in size of the unit because the toner supplying roller 14*a* occupies a large space of the developing unit. Thus, it does not readily contribute to cost reduction.

The inventor and his group have proposed, as a simply constructed means that can ensure the proper transfer of toner, an arrangement of the platelike toner supplying member 14*f* whose main portion is such as sectionally shown in FIG. 32, and verified its practicability. The supply of toner can be improved based on the following two principles.

I. The toner 11*a* is squeezed into a space A' formed by the platelike toner supplying member 14*f*, the toner layer thickness regulating member 14*b* and the toner carrier 14, and since the internal pressure in the space A, is increased by the pressure of successively incoming toner' the toner can readily be supplied on the toner carrier 14 even if consumed in large quantities.

II. A wedgelike space B' formed by the platelike toner supplying member 14*f* and the toner supplying roller 14*a* has its internal pressure increased in the manner similar to the case I, and the toner is likewise pressed on the toner carrier 14 so that the toner is supplied promptly.

In order to obtain the above advantages of I and II simultaneously, it is preferable that the platelike toner supplying member 14*f* should be made of an elastic body or a flexible member and its middle part should be pressed lightly on the toner carrier 14. As a material of the platelike toner supplying member 14*f*, an elastic plate made of above-described rubbers (about 0.5 to 3 mm in thickness); a resin plate (about 20 μm to 1 mm in thickness) can be used; or a silicone rubber, a urethane rubber, a polyester film, a polyimide film, a teflon film, a PET film or the like may more preferably be used.

Also, it is desirable that the platelike toner supplying member 14*f* is releasable from the toner carrier 14 according to the internal pressure generated within the space A' by pushing the toner into the space A' in large quantities while rotating the toner carrier 14 so that the internal pressure allows no excessive toner to pass through under the pressure of the toner layer thickness regulating member 14*b*. The reason for this is because if it is arranged so that the platelike supplying member 14*f* is released from the toner carrier 14 when the internal pressure is increased to reach a predetermined value (dotted line in FIG. 32), there is no likelihood that the internal pressure will exceed a predetermined value and therefore that the toner layer will be excessively thick. If the space A' is made open by the toner supplying member 14*f* which has been released from the toner carrier 14, part of the toner within the space A' may possibly return back to the toner container 11 through the clearance formed between the two members, whereby it is ensured that a possible pressure increase within the space can be properly controlled.

When the elastic or flexible toner layer thickness regulating member 14*b* such as above is used, the aforesaid attaching and releasing operation can be automatically performed in accordance with the rigidity of the plate, thereby supplying the toner with a simpler arrangement. FIG. 33 sectionally shows an example of an arrangement which can provide the same function as the above with a rigid plate. The rigid plate 14*f* is not only pivotably supported by a hinge 14*g* but also pressed on the toner carrier 14 by the spring 14*h*, so that the internal pressure can be controlled in more strict way.

Since the platelike toner supplying member 14*f* or 14*f* is mounted to supply the toner, it is not required that it serve to regulate the toner layer thickness. More strictly speaking, if the toner supplying member 14*f* or 14*f* forms a toner layer of a thickness thinner than the desired, it is not what is intended for. Therefore, when the pressure of the toner layer thickness regulating member 14*b* and the platelike toner supplying member 14*f* (or 14*f*) to be applied to the toner carrier 14 is P1 and P2 [g/cm$^2$], respectively, it is important to adjust them so that P1>P2.

Modifications of the aforesaid toner supplying member 14*f* are sectionally shown in FIGS. 34 and 35. An emphasis is placed on the arrangement of a closed space A' in the modification of FIG. 34. The platelike toner supplying member 14*f* may be made of a rigid plate. In the modification of FIG. 35, an attempt is made to obtain the aforesaid advantage I. In this latter case, no closed space A' is formed, but the wedgelike space B' contributes to promoting the toner supply. Of course, a combination of the platelike toner supplying member 14*f* (or 14*f*) shown in FIGS. 32 to 35 and the toner supplying roller 14*a* shown in FIG. 10 will provide an outstanding advantage in improving the toner transferability.

Excessive electrification of the toner can be prevented by making the platelike toner supplying member 14*f* conductive. The supply of toner to the toner carrier 14 can be further prompted by an electric field generated by applying either a dc or ac voltage or a voltage in which both dc and ac voltages are superimposed. If the toner particles are charged negatively, a potential of the toner supplying member 14*f* should be adjusted to a negative value with respect to the toner carrier 14. Superimposition of a dc electric field over an ac electric field allows toner particles to shuttle between the toner supplying member and the toner carrier and thereby ensure that the toner is supplied to the toner carrier properly. If the surface of the toner carrier 14 is conductive, it is desirable that the surface of the platelike toner supplying member 14*f* confronting the toner carrier 14 should be either a high resistance layer or an insulating layer and the opposite side a conductive layer. The aforesaid voltage should be applied to this conductive layer.

As the toner supplying roller 14*a* of FIG. 10, a polyurethane foam roller impregnated by conductive carbon to give a conductivity of below $10^8$ Ω·cm, and a conductive foam by dispersing conductive carbon in a polyurethane solution before foaming are preferably used. Making the toner supplying roller 14*f* conductive is as important as making the toner supplying member 14*f* conductive in preventing excessive electrification of the toner particles.

As described in the foregoing pages, the third developing unit according to the present invention is capable of producing a constantly uniform thin layer of single component toner in a desired thickness, with its simple, inexpensive, easy-to-assemble arrangement, thereby allowing satisfactory development over a long period of time.

What is claimed is:

1. In a contact type developing method in which a thin layer of toner is formed on the surface of a toner carrier to which a developing bias voltage is applied and said thin layer of toner is supplied to an electrostatic latent image to thereby render said electrostatic latent image visible, the improvement wherein:

when let it be supposed that:

a quantity of electrification of toner that adheres to a latent image holding body by development is q [C/kg];

a quantity of electrification of toner due to its triboelectrification with said latent image holding body is $q_p$ [C/kg];

an electric resistance of said toner carrier is R [$\Omega \cdot m^2$];

an effective length of said toner carrier is l[m];

an effective surface area of said toner carrier is $S_r$, [$m^2$];

a quantity of toner that adheres to said latent image holding body by development is $m_p$ [$kg/m^2$];

a speed of movement of the surface of said latent image holding body is $V_p$ [m/sec];

a quantity of toner that adheres to the surface of said toner carrier is m [$kg/m^2$]; and a speed ratio of the surface of said toner carrier to that of said latent image holding body is k, these values are so adjusted as to satisfy the following conditional expression:

$$-100 < \{-(q-q_p)m_pV_pl + q_p(km-m_p)V_pl\} \cdot R/S_r < 100.$$

2. A developing method according to claim 1, wherein a conductive toner carrier is used as said toner carrier.

3. A developing method according to claim 1, wherein a semiconductive toner carrier is used as said toner carrier.

4. A developing method according to claim 3, wherein a semiconductive toner carrier whose electric resistance is less than $1.5 \times 10^6\ \Omega \cdot m^2$ is used as said toner carrier.

5. A developing method according to claim 3, wherein a semiconductive toner carrier whose electric resistance is less than $1.1 \times 10^5\ \Omega \cdot m^2$ is used as said toner carrier.

6. A developing method according to claim 2 or 3, wherein a protective resistor of approximately $1 \times 10^4$ to $1.5 \times 10^6\ \Omega \cdot m^2$ is interposed between said toner carrier and a biasing power supply for supplying a bias to said toner carrier.

7. A developing method according to claim 1, wherein part of said thin layer of toner remains on the surface of said toner carrier after developing a solid image.

8. A developing method according to claim 1, wherein, when let it be supposed that a quantity of nonmagnetic toner that adheres to the surface of said toner carrier before development is $m_1$ ($mg/cm^2$), a quantity of nonmagnetic toner that is transferred to the surface of said electrostatic latent image by development is $m_2$ ($mg/cm^2$), and a quantity of nonmagnetic toner that remains on the surface of said toner carrier is $m_3$ ($mg/cm^2$), said parameters are adjusted so that they satisfy the relationship $m_2/m_1 \leqq 0.9$ or $m_3/m_1 \geqq 0.1$.

9. A developing method according to claim 1, wherein: when let it be supposed that a speed of movement of the surface of said toner carrier is vt, a speed of movement of the surface of said electrostatic latent image is vi, and a quantity of nonmagnetic toner that adheres to the surface of said toner carrier before development is $m_1$ ($mg/cm^2$), said parameters are adjusted so that they satisfy the relationship $(vt/vi \cdot m_1 \geqq 0.7$.

10. A contact type developing unit for developing an electrostatic latent image comprising:

toner container means for containing a toner;

a toner carrier;

toner supplying means for supplying toner to the toner carrier;

toner layer thickness regulating means for forming a uniform toner layer on the surface of the toner carrier;

an electrostatic latent image holding body for holding on an image surface thereof an electrostatic latent image to be developed;

the toner carrier for supplying the toner layer to the electrostatic latent image on the surface of the electrostatic latent image holding body;

wherein the electrostatic latent image holding body confronts the toner carrier and rotates while carrying the toner layer to render visible the electrostatic latent image on the surface thereof;

wherein the electrostatic latent image holding body, while rotating, is in contact with the toner layer on the toner carrier so as to triboelectrify the toner layer;

charging means for electrostatically charging the electrostatic latent image holding body to serve as a latent image holding body;

exposure means for forming a predetermined latent image on the surface of the electrostatic latent image holding body;

transfer unit means for transferring the electrostatic latent image formed into said visible image on the surface of the electrostatic latent image holding body to a supporting body; and direct current power supply means for supplying a predetermined current to the toner carrier and the toner supplying means for charging the toner layer on the surface of the toner carrier;

wherein the apparatus is operated so as to satisfy a following conditional expression:

$$-100 < \{-(q-q_p)m_pv_pl + q_p(km-m_p)v_pl\} \times R/S_r < 100$$

wherein q is a quantity of electrification (C/kg) of the toner that adheres to the electrostatic latent image holding body, $q_p$ is a quantity of electrification (C/kg) of the toner by triboelectrification with the electrostatic latent image holding body, R is an electrical resistance of the toner carrier ($\Omega \cdot m^2$), l is an effective length (m) of the toner carrier, $S_r$ is an effective surface area ($m^2$) of the toner carrier, $m_p$ is a quantity of the toner ($kg/m^2$) adhering to the electrostatic latent image holding body by development, m is a quantity of the toner ($kg/m^2$) adhering to the surface of the toner carrier, $v_p$ is a moving speed (m/sec) of the surface of the electrostatic latent image holding body, and k is a speed ratio of the surface of the toner carrier to that of the electrostatic latent image holding body.

11. A developing unit according to claim 10, wherein the toner carrier is an elastic conductive roller whose compression set is below 20%.

12. A developing unit according to claim 11, wherein the elastic conductive roller comprises an elastic roller base and a flexible conductive layer formed over the outer surface of the roller base.

13. A developing unit according to claim 12, wherein the conductor layer has a surface roughness of below 20 μm Rz and below 50 μm Rmax.

14. A developing unit according to claim 12, wherein the elastic roller base is made of at least a material selected from the group consisting of urethane, ethylene-propylene rubber, NBR rubber, and silicone rubber, and the conductor layer is made of at least a material selected from the group consisting of urethane and fluorine-contained resin.

15. A developing unit according to claim 10, wherein the toner thickness regulating means comprises means for reducing a pressing force to the toner carrier before operating the developing unit.

16. A developing unit according to claim 10, wherein the toner carrier has a compression set of below 20% and the deformation of the toner carrier by pressing the toner layer thickness regulation means is selected so that a product of the deformation (mm) and the compression set (%) is to be below 0.05 mm.

17. A developing unit according to claim 16, wherein the product is below 0.02 mm.

18. A developing unit according to claim 10, wherein the toner layer thickness regulating means comprises a platelike tip including a high polymer material, said tip for pressing onto the toner carrier.

19. A developing unit according to claim 18, wherein the tip has a cylindrical or curving surface of 0.1 to 20 mm in radius curvature and a rubber hardness of 30 to 100 degrees.

20. A developing unit according to claim 10, wherein the toner supplying means comprises an elastic or flexible platelike toner supplying member, the toner supplying member being arranged adjacent to the toner carrier to supply toner to the toner carrier.

* * * * *

UNITED STATES PATENT AND TRADEMARK OFFICE

CERTIFICATE OF CORRECTION

PATENT NO.: 5,110,705

DATED: May 5, 1992

INVENTOR(S): Hosoya et al.

It is certified that an error appears in the above-identified patent and that said Letters Patent is hereby corrected as shown below:

Column 6, lines 31-32, delete "$-100<\{-(q-q_p)m_pV_p1+q_p(km-m_p)V_p1\}R/-S_r<100$" and insert -- $-100<\{-(q-q_p)m_pV_p1+q_p(km-m_p)V_p1\}R/S_r<100$--.

Column 12, lines 15-16, delete "$-100<\{-(q-q_p)m_pV_p1+q_p(km-m_p)V_p1\}R/-S_r<100$" and insert -- $-100<\{-(q-q_p)m_pV_p1+q_p(km-m_p)V_p1\}R/S_r<100$--.

*Claim 1, column 43, line 6, delete "," after "$S_r$".

Claim 1, column 43,lines 19-20, delete "$-100<\{-(q-q_p)m_pV_p1+q_p(km-m_p)V_p1\}R/-S_r<100$" and insert -- $-100<\{-(q-q_p)m_pV_p1+q_p(km-m_p)V_p1\}R/S_r<100$--.

Claim 10, column 44, lines 35-36, delete "$-100<\{-(q-q_p)m_p v_p1+q_p(km-m_p)v_p1\}R/-S_r<100$" and insert -- $-100<\{-(q-q_p)m_pV_p1+q_p(km-m_p)V_p1\}R/S_r<100$--.

Claim 10, column 44, line 49, delete "$v_p$" and insert --$V_p$--.

Signed and Sealed this

Sixth Day of June, 2000

*Attest:*

Q. TODD DICKINSON

*Attesting Officer*

*Director of Patents and Trademarks*